US009164422B2

(12) United States Patent
Oda

(10) Patent No.: US 9,164,422 B2
(45) Date of Patent: Oct. 20, 2015

(54) DEVELOPER STORAGE BODY, DEVELOPING DEVICE AND IMAGE FORMING APPARATUS HAVING SWING MEMBER

(71) Applicant: Oki Data Corporation, Tokyo (JP)

(72) Inventor: Yukiyoshi Oda, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 16 days.

(21) Appl. No.: 13/928,914

(22) Filed: Jun. 27, 2013

(65) Prior Publication Data

US 2014/0003844 A1 Jan. 2, 2014

(30) Foreign Application Priority Data

Jun. 28, 2012 (JP) ..... 2012-145384

(51) Int. Cl.
*G03G 15/08* (2006.01)

(52) U.S. Cl.
CPC ..... *G03G 15/0839* (2013.01); *G03G 15/0865* (2013.01); *G03G 15/0875* (2013.01); *G03G 15/0877* (2013.01); *G03G 2215/085* (2013.01); *G03G 2215/0852* (2013.01)

(58) Field of Classification Search
CPC ..... G03G 15/0829; G03G 15/0865; G03G 15/087; G03G 2215/085
USPC ..... 399/261, 263
See application file for complete search history.

(56) References Cited

U.S. PATENT DOCUMENTS

| | | | | |
|---|---|---|---|---|
| 5,298,952 | A * | 3/1994 | Kamijo et al. | |
| 6,415,126 | B2 * | 7/2002 | Kaneshige et al. | 399/263 |
| 2002/0028081 | A1 * | 3/2002 | Ito et al. | |
| 2010/0143011 | A1 * | 6/2010 | Tawada | 399/358 |

FOREIGN PATENT DOCUMENTS

| | | | |
|---|---|---|---|
| JP | 2002-072657 | A | 3/2002 |
| JP | 2009080332 | A * | 4/2009 |
| JP | 2009-265375 | A | 11/2009 |

* cited by examiner

*Primary Examiner* — David Gray
*Assistant Examiner* — Laura Roth
(74) *Attorney, Agent, or Firm* — Rabin & Berdo, P.C.

(57) ABSTRACT

A developer storage body includes a storage portion for storing a developer, an agitation member for agitating the developer stored in the storage portion, and a swing member that swings in the storage portion by contact with the agitation member. A contact portion is provided at a first end portion of the swing member. The contact portion contacts the agitation member. A fixed portion and a swing portion are provided at a second end portion of the swing member. The fixed portion is fixed to the storage portion. The swing portion swings in the storage portion.

17 Claims, 21 Drawing Sheets

DEVELOPER STORAGE BODY, DEVELOPING DEVICE AND IMAGE FORMING APPARATUS HAVING SWING MEMBER

BACKGROUND OF THE INVENTION

The present invention relates to an image forming apparatus such as a printer, a facsimile machine and a copier, and also relates to a developer storage body and an image forming unit used in the image forming apparatus.

An image forming apparatus includes an image forming unit having a photosensitive body (i.e., an image bearing body) on which a latent image is formed. The image forming unit further has a developer storage body in which a developer (i.e., a toner) for developing the latent image is stored.

Japanese Laid-open publication No. 2002-072657 discloses a developer storage body having a swing member for scraping a developer from an inner wall of the developer storage body. An upper end of the swing member is fixed to an upper region of the inner wall of the developer storage body. A lower end of the swing member is contactable with an agitation member rotatably provided in the developer storage body. As the agitation member rotates, the swing member vibrates, which helps scrape the developer from the inner wall of the developer storage body.

However, it is still difficult to sufficiently scrape the developer from the inner wall of the developer storage body.

SUMMARY OF THE INVENTION

An aspect of the present invention is intended to provide a developer storage body, an image forming unit and an image forming apparatus capable of reducing an amount of unusable developer in the developer storage body.

According to an aspect of the present invention, there is provided a developer storage body including a storage portion for storing a developer, an agitation member for agitating the developer stored in the storage portion, and a swing member that swings in the storage portion by contact with the agitation member. A contact portion is provided at a first end portion of the swing member. The contact portion contacts the agitation member. A fixed portion is provided at a second end portion of the swing member. The fixed portion is fixed to the storage portion. A swing portion is provided at the second end portion of the swing member. The swing portion swings in the storage portion.

With such a configuration, an amount of unusable developer remaining in the developer storage body can be reduced.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The drawings are provided for illustrative purpose and are not intended to limit the scope of the present invention.

First Embodiment

A developer storage body, an image forming unit and an image forming apparatus of the first embodiment of the present invention will be described with reference to the drawings. In the first embodiment, the present invention is applied to an electrophotographic color image forming apparatus.

<Configuration of First Embodiment>

Figure 1:
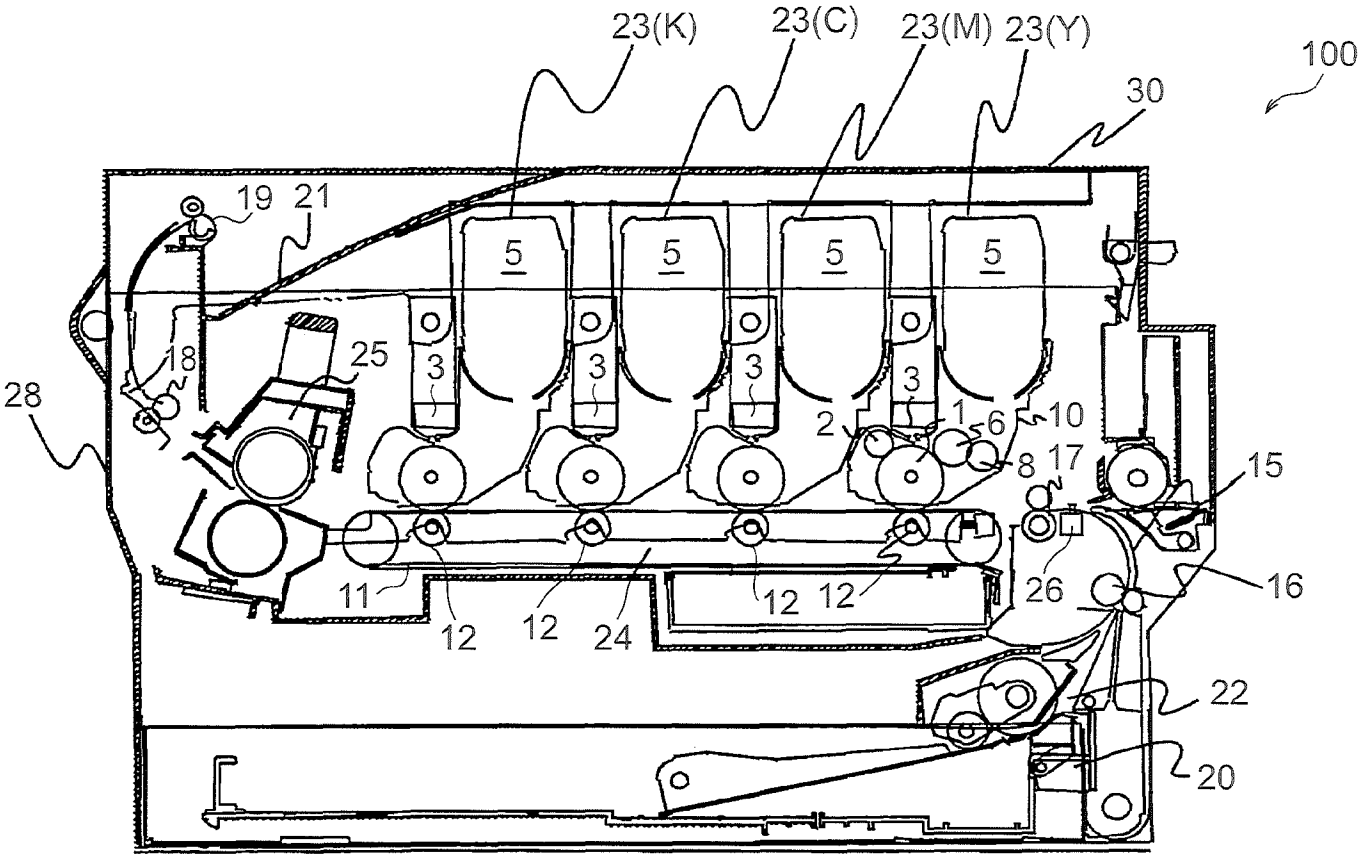
FIG. 1 is a schematic view showing a configuration of an image forming apparatus according to the first embodiment.

FIG. 1 is a schematic view showing a configuration of an image forming apparatus 100 according to the first embodiment. The image forming apparatus 100 includes a medium cassette 20, a medium feeding unit 22, conveying rollers 16, 17, 18 and 19, a medium conveying path 15, a detection unit 26, a transfer belt unit 24, a fixing unit 25, a stacker 21, four developer storage bodies 5, four developing units 23, four light sources 3, a top cover 30 and a lower frame 28. The transfer belt unit 24 includes a transfer belt 11 and transfer rollers 12. The developer storage bodies 5 respectively store developers (i.e., toners) of different colors. For example, the developer storage bodies 5 respectively store the developers of yellow, magenta, cyan and black. The developing units 23 are configured to form developer images using the developers stored in the developer storage bodies 5.

The medium conveying path 15 has a substantially S-shape, and is provided in the lower frame 28. The conveying rollers 16, 17, 18 and 19 are provided along the medium conveying path 15.

The medium cassette 20 is provided on an end of the medium conveying path 15. The medium cassette 20 stores media (i.e., printing sheets). The stacker 21 is provided on the other end of the medium conveying path 15. The stacker 21 is configured to receive the medium ejected out of the medium conveying path 15.

The medium feeding unit 22, the detection unit 26, the transfer belt unit 24 and the fixing unit 25 are arranged along the medium conveying path 15. The medium feeding unit 22 is configured to feed the medium out of the medium cassette 20 into the medium conveying path 15. The detection unit 26 is configured to detect a thickness of the medium. The transfer belt unit 24 (i.e., a transfer unit) includes a transfer belt 11 that holds the medium using electrostatic effect and conveys the medium. The fixing unit 25 is configured to fix a developer image (i.e., a toner image) to the medium.

The developing unit (also referred to as a process unit) 23 includes a photosensitive body (i.e., an image bearing body) 1. A surface of the photosensitive body 1 is exposed with light emitted by the light source 3 based on image information, so that a latent image is formed. The developing unit 23 develops the latent image using a developer (i.e., a toner). For example, the developing units 23 form images of yellow, magenta, cyan and black. The developing unit 23 is disposed so as to face the transfer belt unit 24 via the medium conveying path 15.

Figure 2:
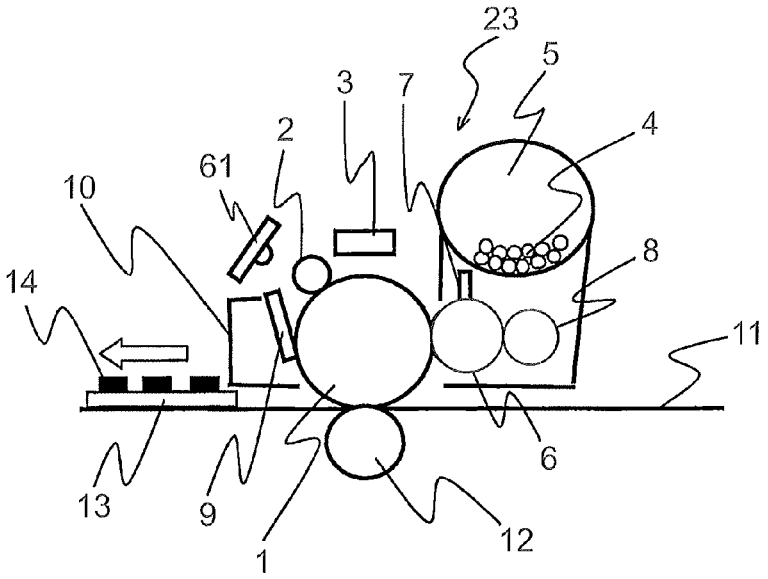
FIG. 2 is a schematic view showing a configuration of a developing unit according to the first embodiment.

FIG. 2 is a schematic view showing a configuration of the developing unit 23 according to the first embodiment. The developing unit 23 includes the photosensitive body 1, a charging roller 2, a developing roller 6, a developing blade 7, a developer supplying roller 8, a cleaning blade 9, a mold 10 and a toner recovery unit 61. The above described light source 3 is provided so as to face the photosensitive body 1.

The developer storage body 5 is detachably mounted to the developing unit 23. FIG. 2 shows a state where the developer storage body 5 is mounted to the developing unit 23. The developing unit 23 and the developer storage body 5 constitute an image forming unit.

The transfer belt 11 and the transfer roller 12 are provided so as to face the photosensitive body 1. The transfer belt 11 and the transfer roller 12 are applied with voltages by a power source, so as to transfer the developer image (shown by numeral 14 in FIG. 2) from the photosensitive body 1 to the medium (shown by numeral 13 in FIG. 2).

The photosensitive body 1 (i.e., an image bearing body) has a surface on which a latent image is formed. The latent image is developed with the developer (shown by numeral 4 in FIG. 2), and the developer image 14 is formed on the surface of the photosensitive body 1. The developer image 14 is transferred to the medium 13. More specifically, the photosensitive body 1 rotates at a predetermined rotational speed. The surface of the photosensitive body 1 is charged by the charging roller 2, and an electric charge is deposited on the surface of the photosensitive body 1. The latent image is formed on the surface of the photosensitive body 1 by being exposed with light emitted by the light source 3. The latent image is developed with the developer supplied by the developing roller 6. The developer image 14 is transferred to the medium 13 conveyed by the transfer belt 11 when the medium 13 passes a nip portion between the photosensitive body 1 and the transfer roller 12.

The charging roller 2 (i.e., a charging member) is configured to apply a predetermined voltage to the surface of the photosensitive body 1. The charging roller 2 is pressed against the surface of the photosensitive body 1, and rotates following the rotation of the photosensitive body 1. The charging roller 2 of this embodiment is configured to charge the photosensitive body 1 by contacting the photosensitive body 1. However, the charging roller 2 can also be configured to charge the photosensitive body 1 in a non-contact manner. Further, the charging roller 2 (i.e., a rotation body) can be replaced with a charging brush.

The light source 3 (i.e., an exposure unit) is configured to emit light to expose the surface of the photosensitive body 1 based on image information. The light source 3 can be constituted by various devices such as an LED optical system or a semiconductor laser optical system.

The developer storage body 5 is configured to store the developer 4 therein. The developer storage body 5 is constituted by, for example, a toner cartridge. The developer storage body 5 is provided on, for example, an upper part of the developing unit 23. The developer 4 stored in the developer storage body 5 is supplied to the developing roller 6 by the developer supplying roller 8, and is further supplied to the photosensitive body 1 to develop the latent image.

The developing roller 6 (i.e., a developer bearing body) is pressed against the photosensitive body 1 and the developer supplying roller 8 respectively with predetermined pressures. The developing roller 6 is configured to supply the developer 4 (supplied from the developer storage body 5) to the photosensitive body 1.

The developing blade 7 (i.e., a developer regulating member) is configured to regulate a thickness of the developer 4 on the surface of the developing roller 6. Along a circumference of the developing roller 6, the developing blade 7 is disposed between the developer supplying roller 8 and the photosensitive body 1, and is disposed upstream of the photosensitive body 1 in a rotating direction of the developing roller.

The developer supplying roller 8 (i.e., a developer supplying member) is configured to supply the developer 4 (supplied from the developer storage body 5) to the developing roller 6.

The cleaning blade 9 (i.e., a cleaning member) is configured to scrape the developer 4 from the surface of the photosensitive body 1 after the developer image 14 is transferred to the medium 13. The cleaning blade 9 is formed of, for example, a metal blade. An edge portion of the metal blade is pressed against the surface of the photosensitive body 1. The developer is scraped from the photosensitive body 1 by means of a resilient force of the metal plate.

The mold 10 constitutes a casing of the developing unit 23.

Next, an external configuration of the developing unit 23 will be described with reference to FIGS. 3 through 8.

Figure 3:
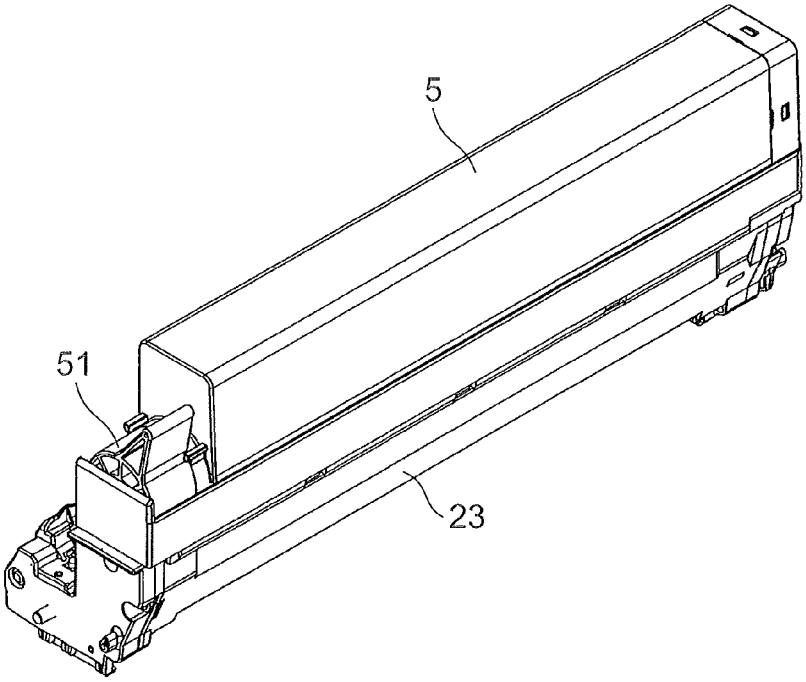
FIG. 3 is a perspective view showing the developing unit with a developer storage body according to the first embodiment.
Figure 4:
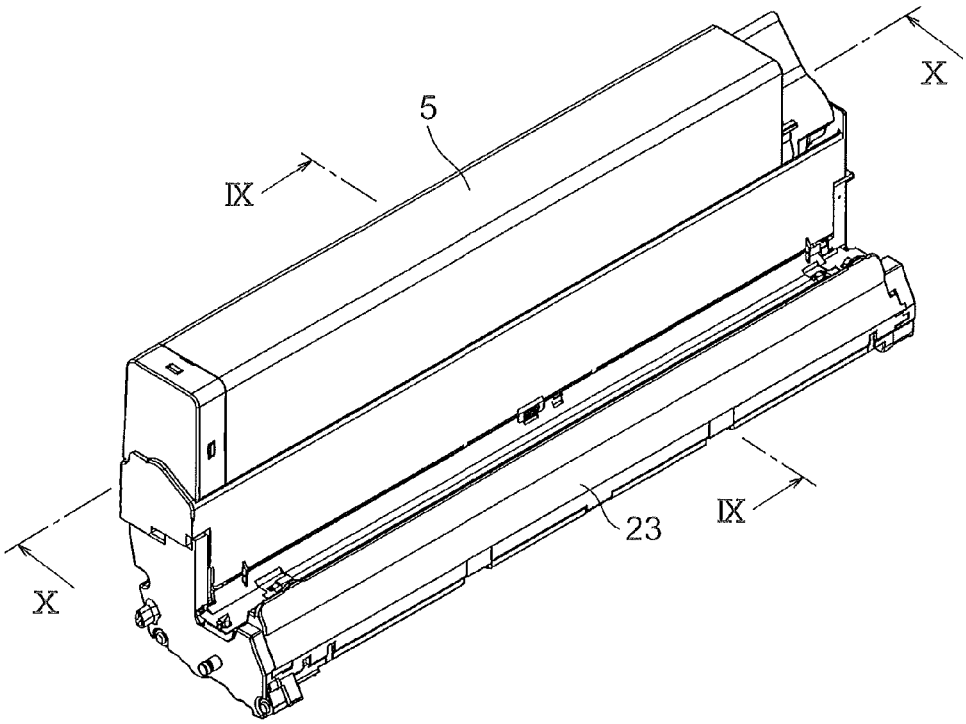
FIG. 4 is a perspective view showing the developing unit with the developer storage body according to the first embodiment.

FIGS. 3 and 4 are top perspective views showing the external configuration of the developing unit 23 to which the developer storage body 5 is mounted. In this regard, FIGS. 3 and 4 are top perspective views from opposite directions.

Figure 5:
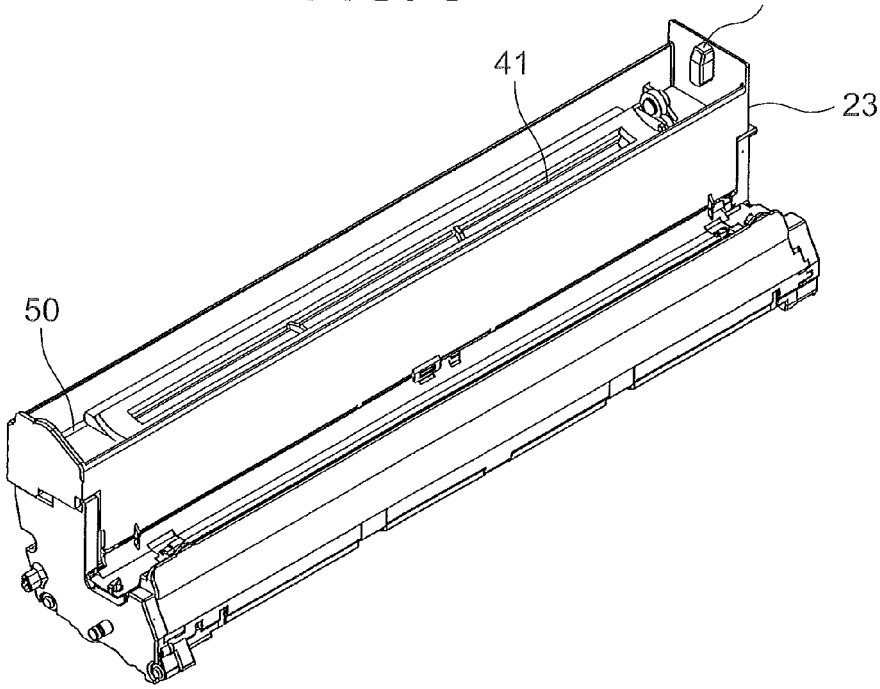
FIG. 5 is a perspective view showing the developing unit according to the first embodiment.
Figure 6:
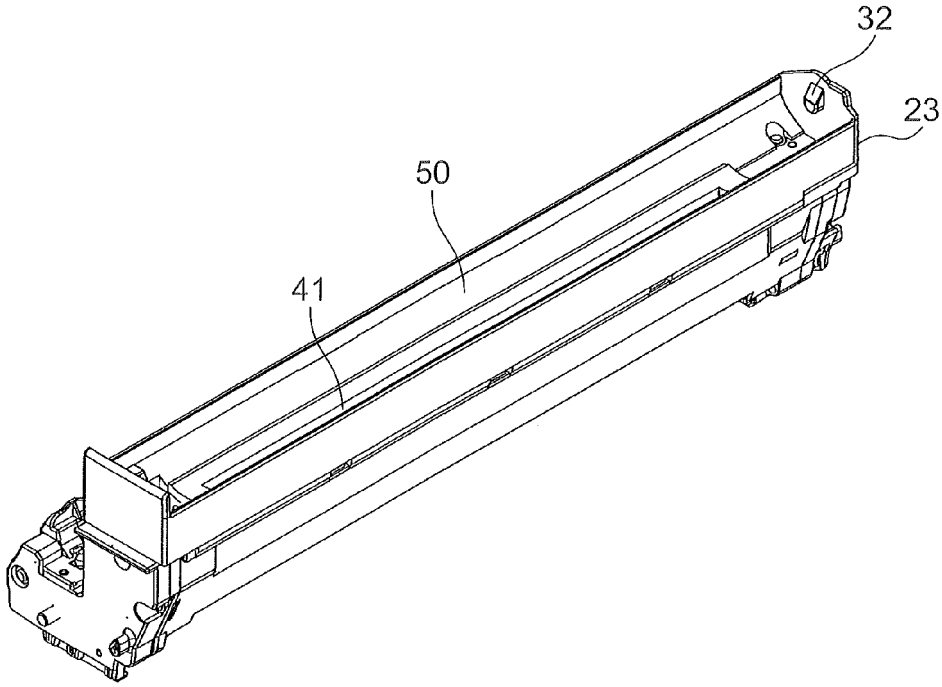
FIG. 6 is a perspective view showing the developing unit according to the first embodiment.
Figure 7:
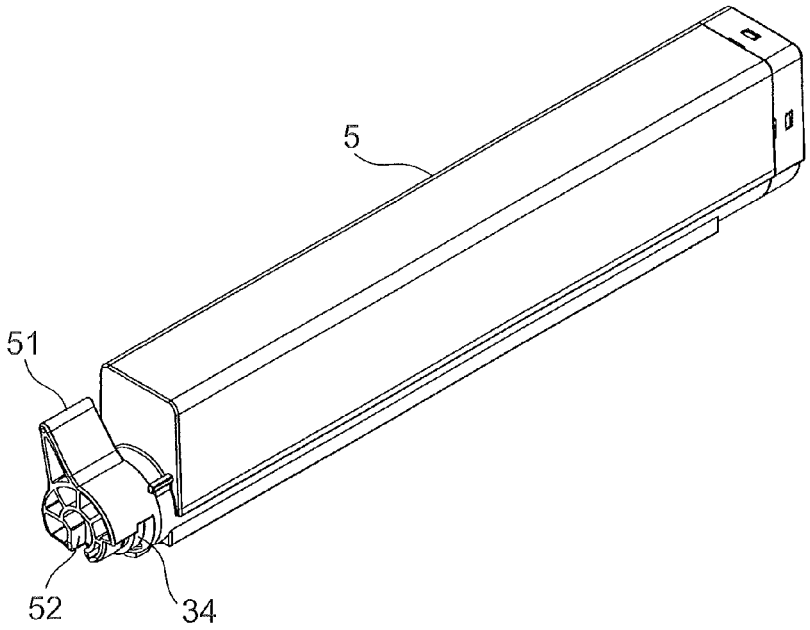
FIG. 7 is a perspective view showing the developer storage body according to the first embodiment.
Figure 8:
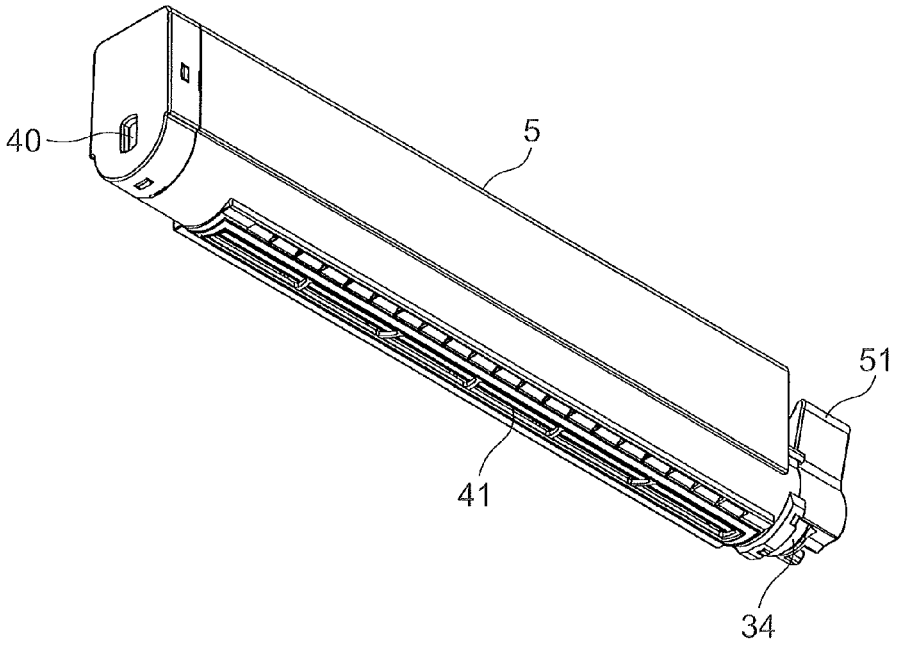
FIG. 8 is a bottom perspective view showing the developer storage body according to the first embodiment.

FIGS. 5 and 6 are top perspective views showing the external configuration of the developing unit 23 without the developer storage body 5. FIGS. 7 and 8 are perspective views showing the developer storage body 5. In this regard, FIG. 7 is a top perspective view, while FIG. 8 is a bottom perspective view.

As shown in FIGS. 5 and 6, the developing unit 23 has a developer storage body mounting portion 50 to which the developer storage body 5 is mounted. The developer storage body mounting portion 50 has a substantially rectangular shape as shown FIGS. 5 and 6. A developer supplying opening 41 (i.e., an ejection portion) is provided on a bottom of the developer storage body mounting portion 50. The developer supplying opening 41 is provided for supplying the developer 4 from the developer storage body 5 mounted to the developer storage body mounting portion 50. A retainer post 53 is formed on an inner wall at an end of the developer storage body mounting portion 50 in a longitudinal direction of the developer storage body 5 as shown in FIG. 5. Further, a positioning post 32 is formed on an inner wall at the other end of the developer storage body mounting portion 50 in the longitudinal direction as shown in FIG. 6.

Further, a gear 34 is provided at an end of the developer storage body 5 in the longitudinal direction as shown in FIG. 7. A positioning hole 40 is formed at the other end of the developer storage body 5 in the longitudinal direction as shown in FIG. 8. A groove portion 52 (FIG. 7) of the gear 34 of the developer storage body 5 engages the retainer post 53 (FIG. 5) of the developer storage body mounting portion 50, and the positioning hole 40 (FIG. 8) of the developer storage body 5 engages the positioning post 32 (FIG. 6) of the developer storage body mounting portion 50, so that the developer storage body 5 is mounted to the developer storage body mounting portion 50 of the developing unit 23 as shown in FIGS. 3 and 4.

Figure 9:
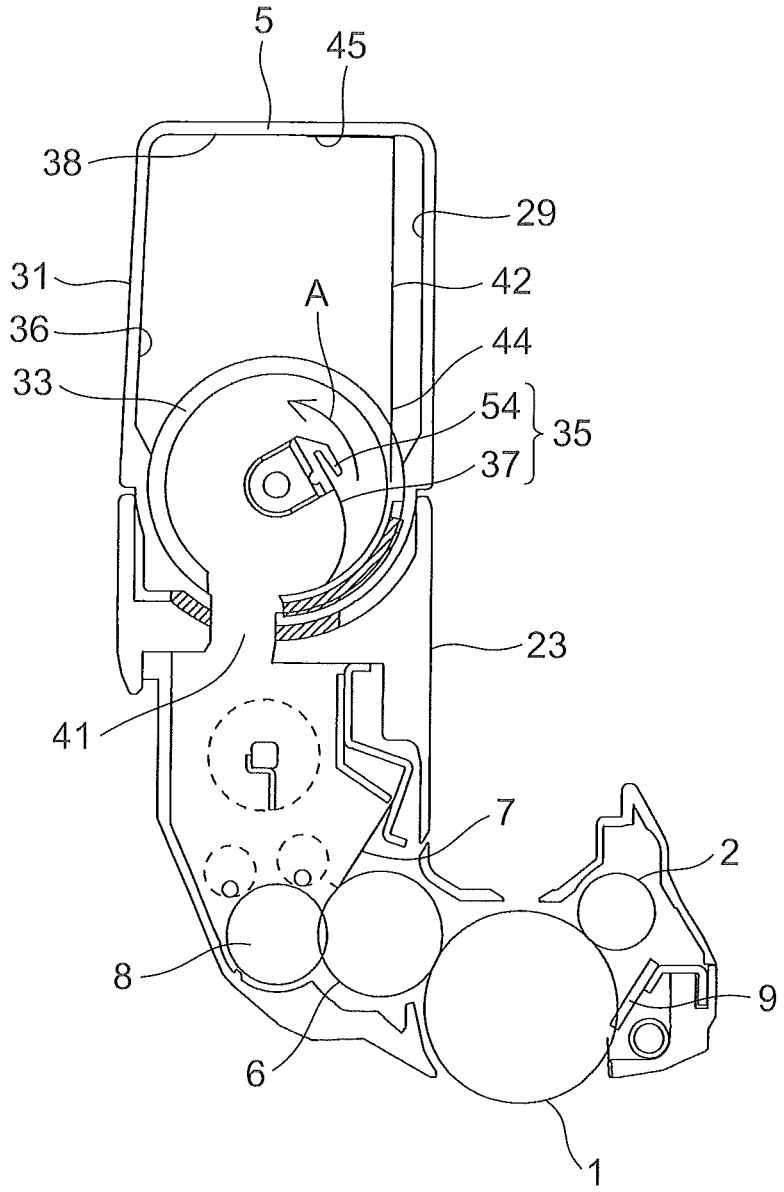
FIG. 9 is a cross sectional view showing the image forming unit according to the first embodiment taken along line IX-IX in FIG. 4.

An internal configuration of the developer storage body 5 will be described. FIG. 9 is a cross sectional view of the developing unit 23 with the developer storage body 5 taken along line IX-IX in FIG. 4.

As shown in FIG. 9, the developer storage body 5 includes a developer storage portion 31 (i.e., a storage portion). The developer storage body 5 further includes a shutter 33, an agitation member 35 and a swing member 42 provided in the developer storage portion 31.

The shutter 33 opens the developer supplying opening 41 to supply the developer 4, and closes the developer supplying opening 41 to stop supplying the developer 4. Although the shutter 33 rotates to open and close the developer supplying opening 41 in this embodiment, the shutter 33 is not limited to such a structure.

The gear 34 (FIG. 7) is fixed to a supporting portion 54 of the agitation member 35. The gear 34 is rotated by a driving force transmitted from the developing unit 23, and the agitation member 35 rotates to agitate the developer 4 in the developer storage portion 31. The agitation member 35 includes the supporting portion 54 (i.e., a rotation member) which is rotatably mounted, and a sheet 37 (i.e., an agitation body) mounted to the supporting portion 54. The agitation member 35 rotates in a direction shown by an arrow A, i.e., counterclockwise in FIG. 9. Hereinafter, the direction shown by the arrow A is referred to as the "rotating direction A". The sheet 37 scrapes the developer from an inner wall of the developer storage portion 31.

The developer storage portion 31 has an inner wall 36 including a top surface 38 and four side surfaces. Among the four side surfaces, one side surface (parallel to a longitudinal direction of the developer storage body 5) disposed on an upstream side in the rotating direction A of the agitation member is referred to as a "first side surface 29". Two side surfaces (perpendicular to the longitudinal direction of the developer storage body 5) are referred to as "second side surfaces 39" (see FIG. 10).

The swing member 42 has an end (here, a lower end) contacting the agitation member 35, and has the other end (here, an upper end) fixed to the top surface 38 of the developer storage body 5. As the agitation member 35 rotates, the swing member 42 swings to scrape the developer 4 from the first side surface 29 and the top surface 38 of the developer storage body 5. In this regard, the top surface 38 is a fixing surface to which fixed portions 45 (described later) of the swing member 42 are fixed. Further, the top surface 38 is an opposing surface opposing the developer supplying opening 41 (i.e., an ejection opening).

Figure 10:
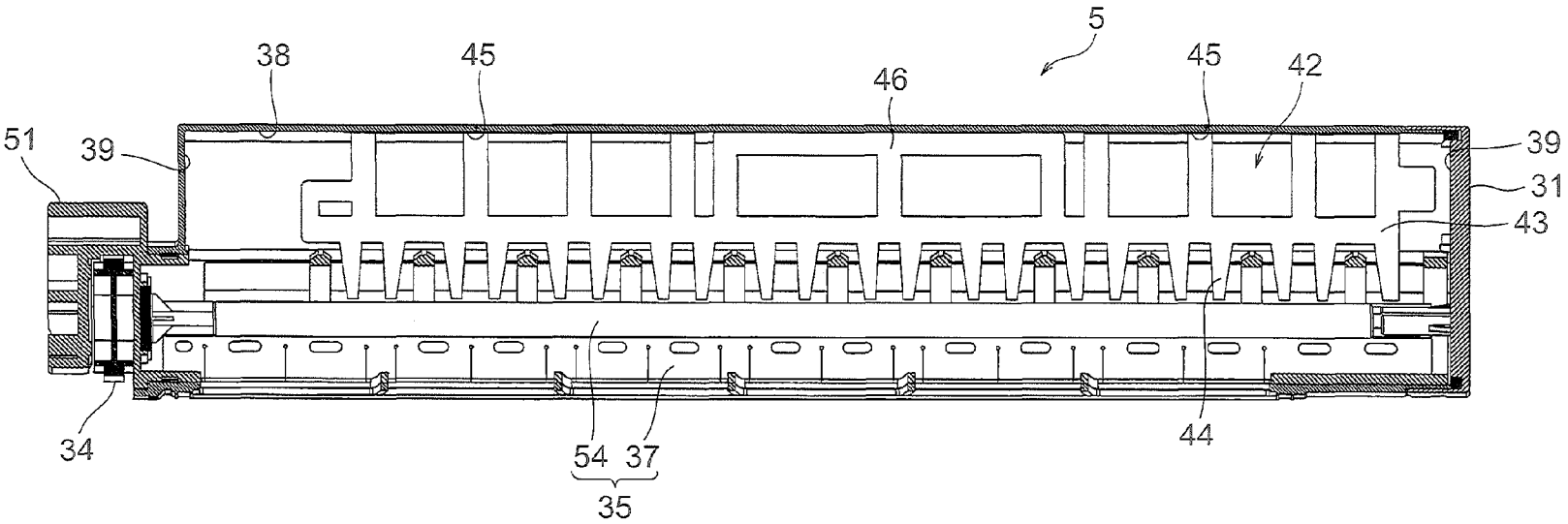
FIG. 10 is a longitudinal sectional view showing the image forming unit according to the first embodiment taken along line X-X in FIG. 4.
Figure 11:
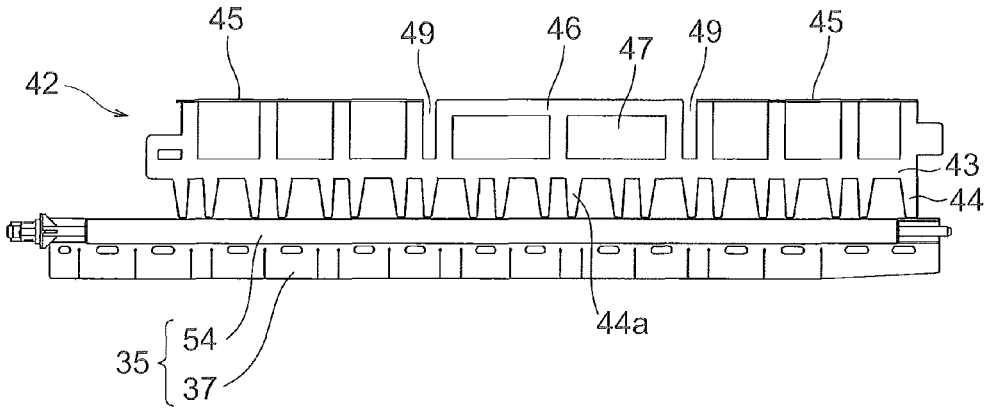
FIG. 11 is a front view showing an agitation member and a swing member provided in the developer storage body according to the first embodiment.
Figure 12:
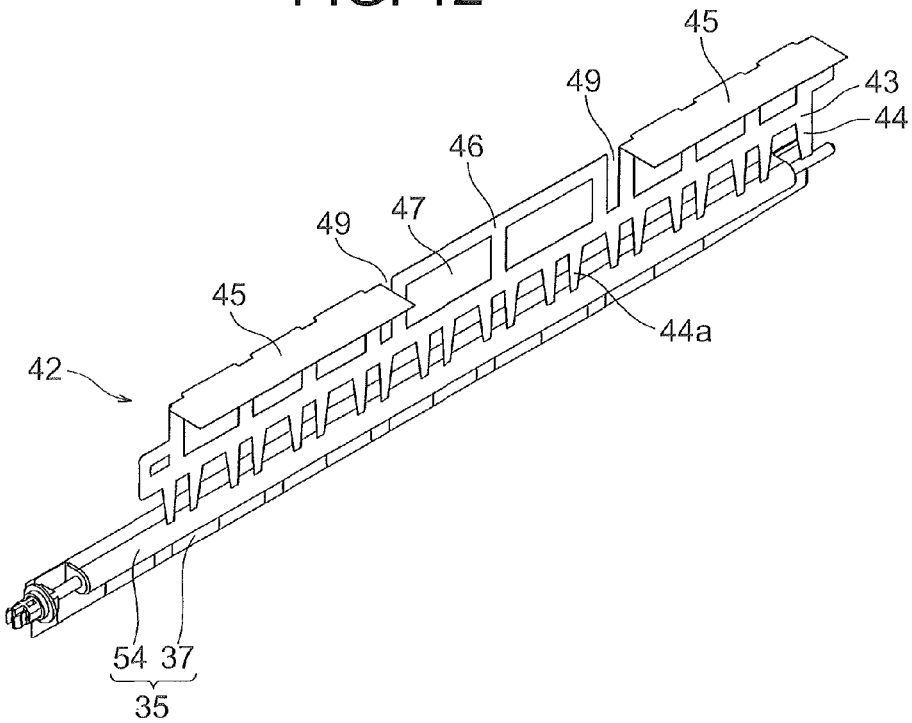
FIG. 12 is a perspective view showing the agitation member and the swing member provided in the developer storage body according to the first embodiment.
Figure 13:
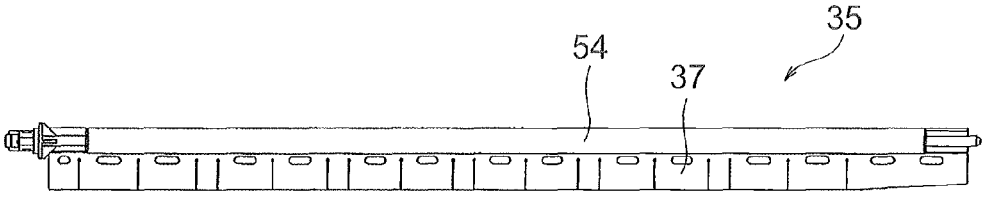
FIG. 13 is a front view showing the agitation member provided in the developer storage body according to the first embodiment.
Figure 14:
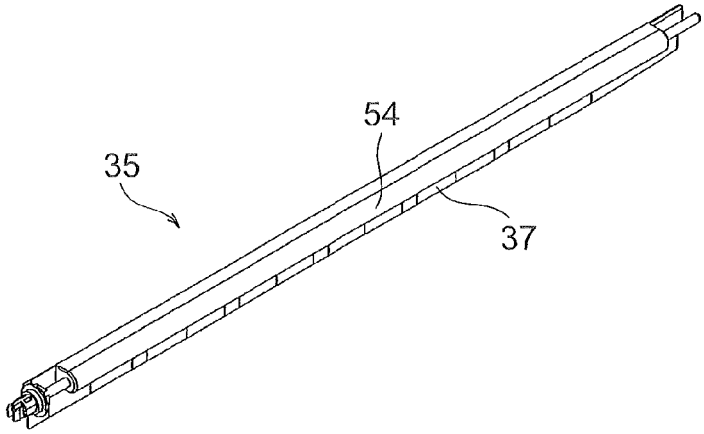
FIG. 14 is a perspective view showing the agitation member according to the first embodiment.
Figure 15:
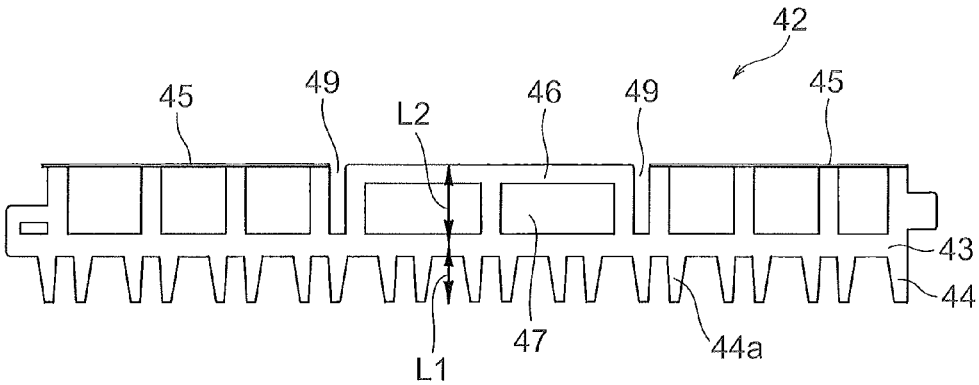
FIG. 15 is a front view showing the swing member according to the first embodiment.
Figure 16:
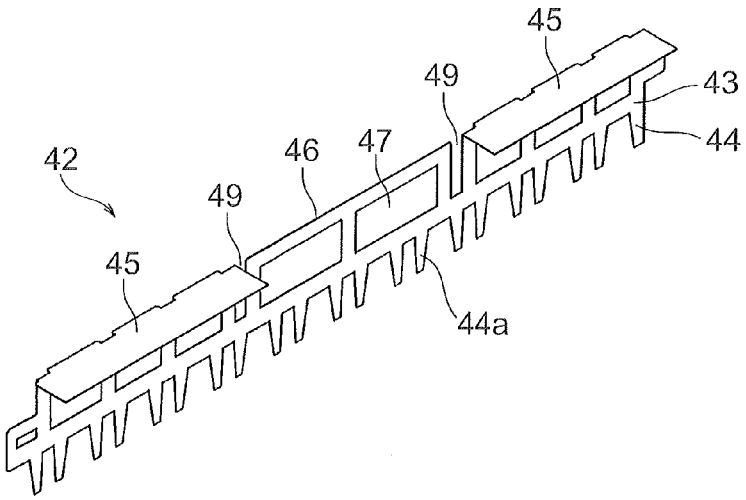
FIG. 16 is a perspective view showing the swing member according to the first embodiment.

FIG. 10 is a longitudinal sectional view of the developer storage body 5 and the developing unit 23 taken along line X-X in FIG. 4. FIG. 11 is a front view showing the agitation member 35 and the swing member 42. FIG. 12 is a perspective view showing the agitation member 35 and the swing member 42. FIGS. 13 and 14 are a front view and a perspective view showing the agitation member 35. FIGS. 15 and 16 are a front view and a perspective view showing the swing member 42.

As shown in FIGS. 13 and 14, the agitation member 35 has an elongated shape. The agitation member 35 includes the rotatable supporting portion 54 to which the gear 34 is fixed, and the sheet 37 (the agitation body) mounted to the supporting portion 54.

As shown in FIGS. 15 and 16, the swing member 42 has an elongated shape. A deflection portion 44 (i.e., a contact portion) is formed on an end portion (i.e., a first end portion) of the swing member 42 in a direction perpendicular to a longitudinal direction of the swing member 42. Fixed portions 45 and a sliding portion 46 (i.e., a swing portion) are formed on the other end portion (i.e., a second end portion) of the swing member 42 in the direction perpendicular to the longitudinal direction of the swing member 42.

The swing member 42 can be formed of various material having resiliency. For example, the swing member 42 is made of a sheet or film of PET (Poly-Ethylene Terephthalate) having a thickness of approximately 0.1 mm. The swing member 42 has a plurality of rectangular openings 47 for reducing a rotational load applied to the agitation member 35 when the swing member 42 contacts the agitation member 35.

When the deflection portion 44 contacts the agitation member 35, the deflection portion 44 is deflected by the rotation of the agitation member 35, and generates a resilient force to recover its original shape. With the resilient force, the deflection portion 44 vibrates, and the sliding portion 46 scrapes the developer 4 from the inner wall 36 of the developer storage portion 31. When the swing member 42 swings, the sliding portion 46 slides on the top surface 38, and scrapes the developer 4 adhering to the top surface 38. Further, when the swing member 42 swings, the sliding portion 46 also removes the developer 4 adhering to parts of the top surface 38 and the first side surface 29 that the sliding portion 46 does not contact.

A connecting portion 43 is provided so as to extend in the longitudinal direction of the developer storage body 5. The connecting portion 43 is formed to connect the deflection portion 44 and the fixed portions 45 as well as the sliding portion 46.

The deflection portion 44 is provided on an end of the swing member 42 as described above. The deflection portion 44 contacts the agitation member 35 and is deformed by the rotation of the agitation member 35. Although a shape of the deflection portion 44 is not limited, the deflection portion 44 preferably has a shape capable of reducing rotational load of the agitation member 35. For example, as shown in FIG. 16, the deflection portion 44 has a comb-like shape. A width of each comb-tooth 44*a* of the deflection portion 44 is preferably approximately 5 mm.

The fixed portions 45 are fixed to the top surface 38 of the developer storage body 5, and support an entire body of the swing member 42. It is only necessary that the fixed portions 45 support the swing member 42 in a stable manner. Therefore, in this embodiment, the fixed portions 45 are formed on both ends of the swing member 42 in the longitudinal direction of the swing member 42. More specifically, the swing member 42 is divided into three sections equally in the longitudinal direction, and the fixed portions 45 are formed on two end sections. Lengths of the fixed portions 45 are not limited. Further, the number of the fixed portion(s) 45 can be one, two or more.

When the sliding portion 46 swings, the sliding portion 46 slides on the top surface 38 of the developer storage portion 31, and scrapes the developer 4 adhering to the top surface 38. Further, when the sliding portion 46 swings, the sliding portion 46 also removes the developer 4 adhering to the parts of the top surface 38 and the first side surface 29 that the sliding portion 46 does not contact. The sliding portion 46 is provided at a center portion of the swing member 42 in the longitudinal direction of the swing member 42. That is, the sliding portion 46 is provided between the two fixed portions 45.

Here, a length from the connecting portion 43 to a tip of the deflection portion 44 (i.e., the contact portion) is expressed as L1. A length from the connecting portion 43 to a tip of the sliding portion 46 (i.e., the swing portion) is expressed as L2. It is preferred that the length L1 is shorter than the length L2 (L1<L2).

The fixed portions 45 are provided on both end portions of the swing member 42 in the longitudinal direction. The sliding portion 46 is provided on the center portion of the swing member 42 in the longitudinal direction. In this example, the fixed portions 45 have bent shapes and are fixed to the top surface 38 of the developer storage portion 31. More specifically, the fixed portions 45 have facing portions that face the top surface 38 and extend along the top surface 38. However, the fixing portions 45 are not limited to such a configuration. For example, the fixed portions 45 can also be fixed to the second side surfaces 39 of the developer storage portion 31. Further, the fixed portions 45 can also be fixed to ribs protruding from the top surface 38. The fixed portions 45 can also be fixed using adhesive force (i.e., using double-sided tapes or adhesive agent), thermal caulking, screws, or latching. Furthermore, the fixing portions 45 can also be formed to cramp a frame of the developer storage body 5.

Slit portions 49 are formed between the sliding portion 46 and the fixed portions 45. When the deflection portion 44 is applied with a force by the rotating agitation member 35, the deflection portion 44 is deflected while being supported by the fixed portions 45. When the agitation member 35 departs from the deflection portion 44, the swing member 42 entirely swings due to the resilient force of the deflection portion 44. With the swinging of the swing member 42, the swing member 42 can scrape the developer adhering to the top surface 38 of the developer storage portion 31. Additionally, in this embodiment, since the slit portions 49 are formed between the sliding portion 46 and the fixed portions 45, the resilient force of the deflection portion 44 is effectively transmitted to the sliding portion 46, with the result that swinging amount of the sliding portion 46 becomes larger. Accordingly, it becomes possible to scrape the developer 4 from the top surface 38 that the sliding portion 46 contacts, and to scrape the developer 4 from the parts of the top surface 38 and the first side surface 29 that the sliding portion 46 does not contact.

<Operation of First Embodiment>

An image forming operation of the image forming apparatus 100 will be described with reference to FIG. 1.

In FIG. 1, the medium (sheet) is fed out of the medium cassette 20 into the medium conveying path 15 by the medium feeding unit 22. The medium is conveyed along the medium conveying path 15 by the conveying rollers 16 and 17.

While the medium is conveyed along the medium conveying path 15, the thickness of the medium is detected by the detection unit 26. After the medium reaches the transfer belt unit 24, the medium is conveyed by the transfer belt 11 along the developing units 23. As the medium passes the developing units 23, the developer images of yellow, magenta, cyan and black are respectively transferred from the photosensitive bodies 1 to the medium. Then, the medium is conveyed to the fixing unit 25, and the developer image is fixed to the medium. The medium is then ejected outside by the conveying rollers 18 and 19, and is placed on the stacker 21.

Next, an image forming operation in the developing unit 23 will be described with reference to FIG. 2.

The photosensitive body 1 is applied with the voltage by the charging roller 2, and an electric charge is deposited on the surface of the photosensitive body 1. The light source 3 emits light to expose the surface of the photosensitive body 1 based on image information, and a latent image is formed on the photosensitive body 1.

The developer 4 stored in the developer storage body 5 is supplied to the developing roller 6 by the developer supplying roller 7. The developer 4 supplied to the developing roller 6 is formed into a developer layer having a predetermined thickness by the developing blade 7. The developer 4 on the surface of the developing roller 6 adheres to the latent image on the surface of the photosensitive body 1 to develop the latent image.

Here, an operation of the developer storage body 5 of the first embodiment will be described.

The developer storage body 5 is detachably mounted to the developing unit 23. When the developer storage body 5 is mounted to the developing unit 23, it becomes possible to supply the developer 4 from the developer storage body 5 to the developing unit 23.

As shown in FIGS. 5 through 8, when the developer storage body 5 is mounted to the developing unit 23, the positioning post of the mold 10 of the developing unit 23 engages the positioning hole 40 of the developer storage body 5, and a position of the developer storage body 5 in a lateral direction is determined.

Then, the retainer post 53 of the developing unit 23 is fitted into the groove portion 52 of the lever 51 of the developer storage body 5. A user rotates the lever 51 to a position where the groove portion 52 receives the retainer post 53 from below. In this state, the developer storage body 5 is locked in a vertical direction. Further, the operation of the lever 51 causes the shutter 33 to open the developer supplying opening 41, and it becomes possible to supply the toner 4 to the developing unit 23.

When the developing unit 23 is driven, the gear 34 rotates by a driving force transmitted from the developing unit 23, and the agitation member 35 in the developer storage portion 31 also rotates. When the agitation member 35 rotates, the agitation member 35 agitates the developer 4 in the developer storage portion 31, and the developer 4 is supplied to the developing unit 23.

Further, as the agitation member 35 rotates, the sheet 37 of the agitation member 35 contacts the deflection portion 44 of the swing member 42, and causes the swing member 42 to swing. The swing member 42 slides on the first side surface 29 and contacts the top surface 38, and scrapes the developer 4.

Figure 17B:
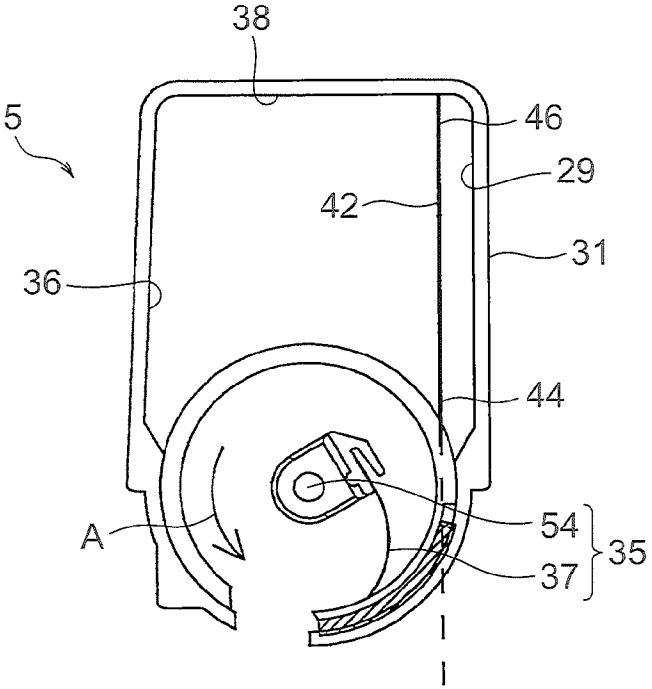
FIGS. 17A and 17B are cross sectional views showing operations of the agitation member and the swing member according to the first embodiment.
Figure 17A:
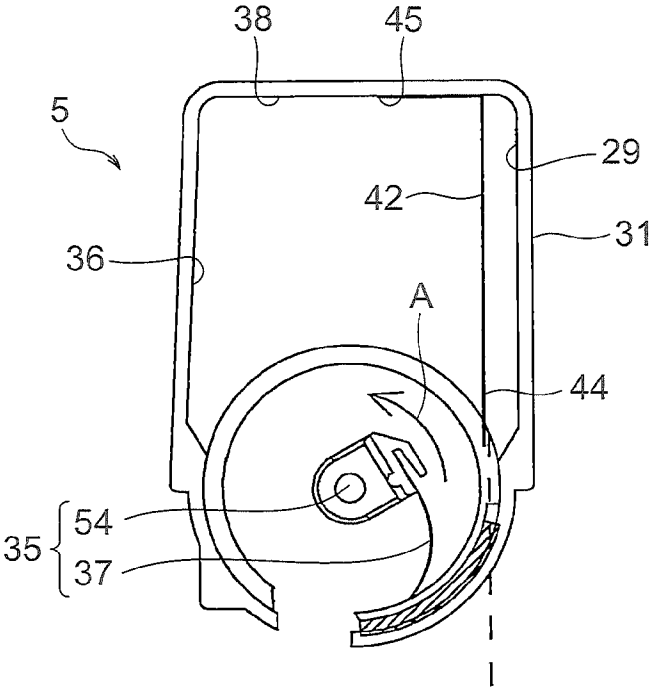
Figure 18B:
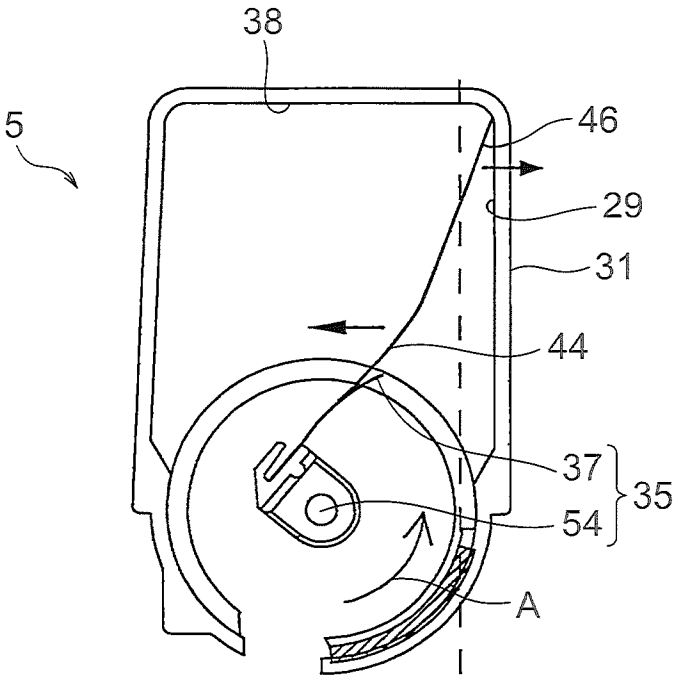
FIGS. 18A and 18B are cross sectional views showing the operations of the agitation member and the swing member according to the first embodiment.
Figure 18A:
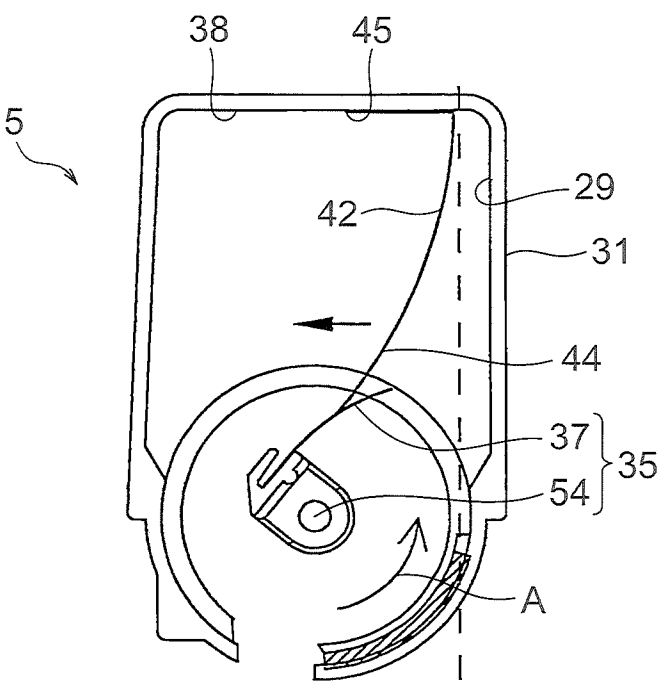
Figure 19B:
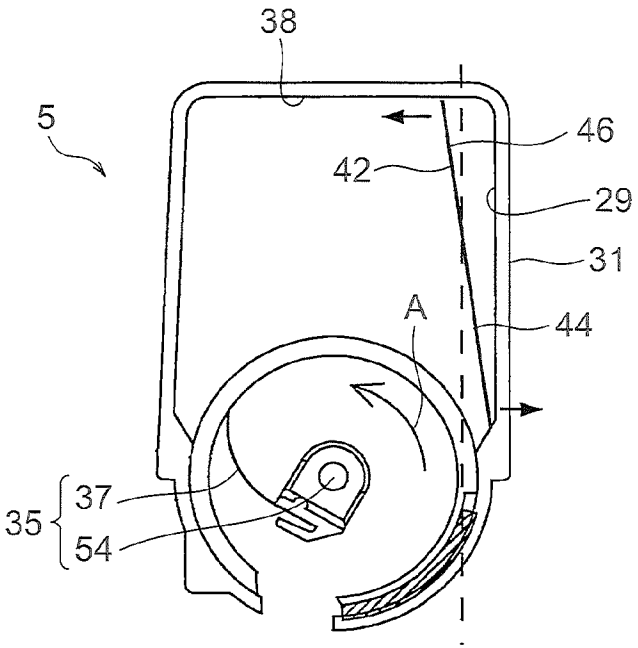
FIGS. 19A and 19B are cross sectional views showing the operations of the agitation member and the swing member according to the first embodiment.
Figure 19A:
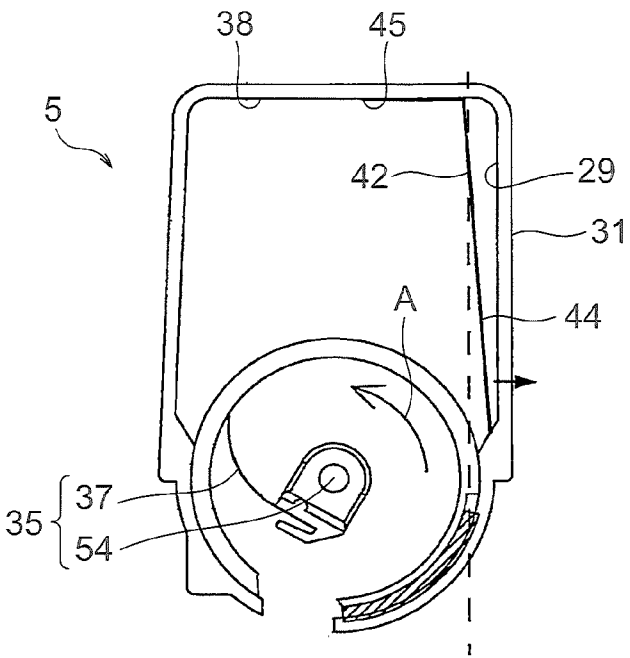

Operations of the agitation member 35 and the swing member 42 will be described. FIGS. 17A, 17B, 18A, 18B, 19A and 19B are explanatory views for illustrating the operations of the agitation member 35 and the swing member 42. In this regard, FIGS. 17A, 18A and 19A are cross sectional views taken along a plane passing through the fixed portion 45 of the swing member 42. FIGS. 17B, 18B and 19B are cross sectional views taken along a plane passing through the sliding portion 46 of the swing member 42.

FIGS. 17A and 17B show a state before the sheet 37 of the agitation member 35 contacts the swing member 42. In FIGS. 17A and 17B, the agitation member 35 rotates in the rotating direction A, but the sheet 37 does not contact the deflection portion 44 of the swing member 42. Therefore, the fixed portions 45 and the swing portion 46 do not swing.

When the agitation member 35 rotates, and the sheet 37 of the agitation member 35 contacts the swing member 42 as shown in FIG. 18A. As shown in FIG. 18A, the deflection portion 44 is pushed by the agitation member 35, and therefore the swing member 42 is entirely deflected in the rotating direction A about the fixed portions 45 as a fulcrum. With such a deflection, the swing member 42 causes the surrounding developer 4 to move, and disperses agglomeration of the developer 4.

Here, as shown in FIG. 18B, the sliding portion 46 (i.e., the swing portion) of the swing member 42 is not fixed to the inner wall 36 of the developer storage portion 31. Therefore, the sliding portion 46 is deflected and slides on the top surface 38 in a direction opposite to the rotating direction A about the connecting portion 43 as a fulcrum. Therefore, the sliding portion 46 scrapes the developer 4 adhering to the top surface 38. Further, the sliding portion 46 also contacts the first side surface 29, and scrapes the developer 4 adhering to the first side surface 29.

When the agitation member 35 further rotates, the sheet 37 of the agitation member 35 departs from the deflection portion 44 of the swing member 42 as shown in FIG. 19A. The swing member 42 speedily moves in the direction opposite to the rotating direction A of the agitation member 35 about the fixed portion 45 as the fulcrum. That is, the swing member 42 moves to return to its original position by its own resiliency. In this state, the swing member 42 moves beyond the original position by momentum, and therefore a vibration of the swing member 42 occurs. The vibration of the swing member 42 moves the surrounding developer 4, and disperses the agglomeration of the developer 4. Further, the swing member 42 contacts the first side surface 29, and scrapes the developer 4 adhering to the first side surface 29.

Here, as shown in FIG. 19B, the sliding portion 46 (i.e., the swing portion) of the swing member 42 is not fixed to the inner wall 36 of the developer storage portion 31. Therefore, the sliding portion 46 slides on the top surface 38 in the rotating direction A about the connecting portion 43 as the fulcrum. Further, the sliding portion 46 moves beyond its original position by momentum, and scrapes the developer 4 adhering to the top surface 38.

As the agitation member 35 continues to rotate, the operations shown in FIGS. 17A through 19B are repeated. With such operations, the developer 4 adhering to the inner wall 36 (particularly, the top surface 38 and the first side surface 29) of the developer storage portion 31 can be moved, dispersed and scraped therefrom.

FIGS. 17A through 19B show the case in which the sheet 37 of the agitation member 35 contacts the deflection portion 44 (i.e., the contact portion) of the swing member 42. However, the same effect can be obtained when the supporting portion 54 of the agitation member 35 contacts the swing member 42.

As shown in FIGS. 15 and 16, the fixed portions 45 are formed at an end portion of the swing member 42 in a direction perpendicular to the connecting portion 43, and therefore the swing member 42 can swing by a large amount. Further, the length L2 from the connecting portion 43 to the sliding portion 46 is longer than the length L1 from the connecting portion 43 to the deflection portion 44 (i.e., L1<L2). Since the sliding portion 46 (i.e., the swing portion) swings about the connecting portion 43 as the fulcrum, the sliding portion 46 can swing by a larger amount.

As shown in FIGS. 15 and 16, since the openings 47 are formed on the swing member 42, it becomes possible to reduce a force applied to the swing member 42 by the developer 4 when the swing member 42 swings. Therefore, increase in the rotational load applied to the agitation member 35 can be suppressed. Further, since the openings 47 are formed on the swing member 42, an area where the swing member 42 contacts the first side surface decreases. Therefore, it becomes possible to prevent the developer 4 from being pressed against the first side surface 29 by the swing member 42.

<Effects of First Embodiment>

As described above, according to the first embodiment, the deflection portion 44 (i.e., the contact portion) is provided at the first end portion of the swing member 42, and the fixed portions 45 and the sliding portion 46 are provided at the second end portion of the swing member 42. The agitation member 35 contacts the swing member 42 to cause the swing member 42 to swing so as to scrape the developer 4 from the inner wall 36 of the developer storage portion 31. Therefore, an amount of the developer 4 remaining in the developer storage portion 31 (i.e., unusable developer) can be reduced, and the developer 4 stored in the developer storage portion 31 can be efficiently and effectively used.

<Modifications>

Modifications of the first embodiment will be described with reference to FIGS. 20 through 25. In FIGS. 20 through 25, elements that are the same as those of the above described swing member 42 are assigned the same reference numerals.

Figure 20:
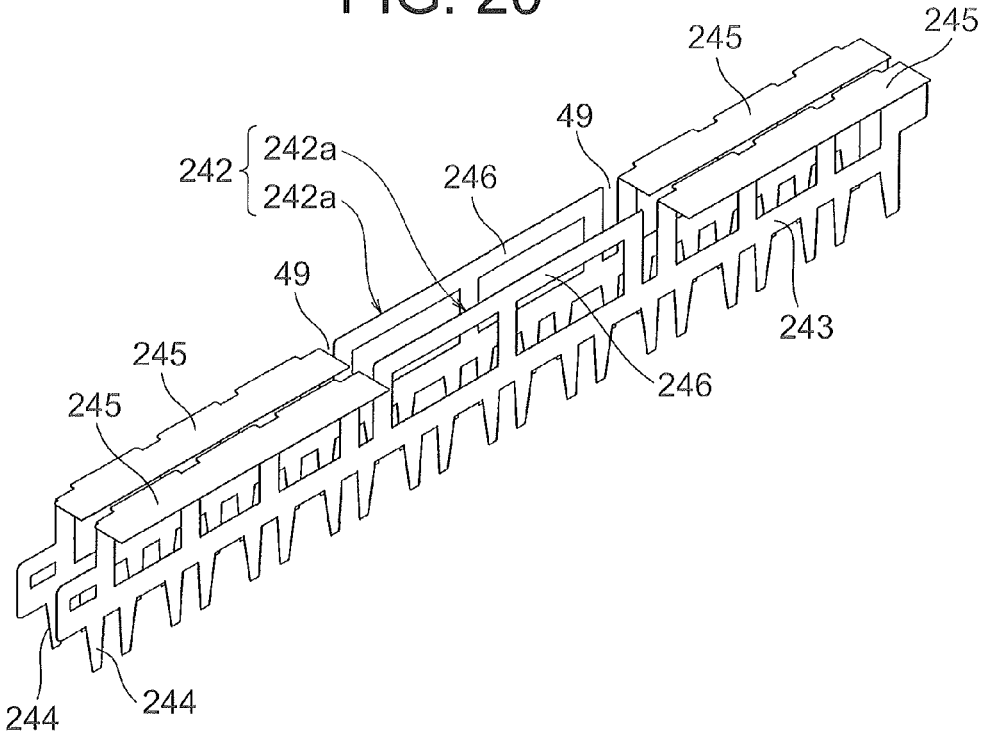
FIG. 20 is a perspective view showing a swing member of a first modification of the first embodiment.

FIG. 20 is a perspective view showing a swing member 242 of a first modification of the first embodiment. The swing member 242 of the first modification includes a plurality of (for example, two) swing member element 242*a* provided in parallel with each other. Each of the swing member elements 242*a* has the same structure as the swing member 42 of FIGS. 15 and 16. That is, each swing member element 242*a* has a deflection portion 244, a connecting portion 243, fixed portions 245 and a swing portion 246 which are the same as those of the swing member 42 of FIGS. 15 and 16. The number of the swing member elements 242*a* is not limited to 2, but can be 3 or more.

Since the swing member 242 includes a plurality of swing member elements 242*a* as shown in FIG. 20, it becomes possible to reduce the developer 4 adhering to the side surface of the developer storage body 31 opposing the first side surface 29.

Figure 21:
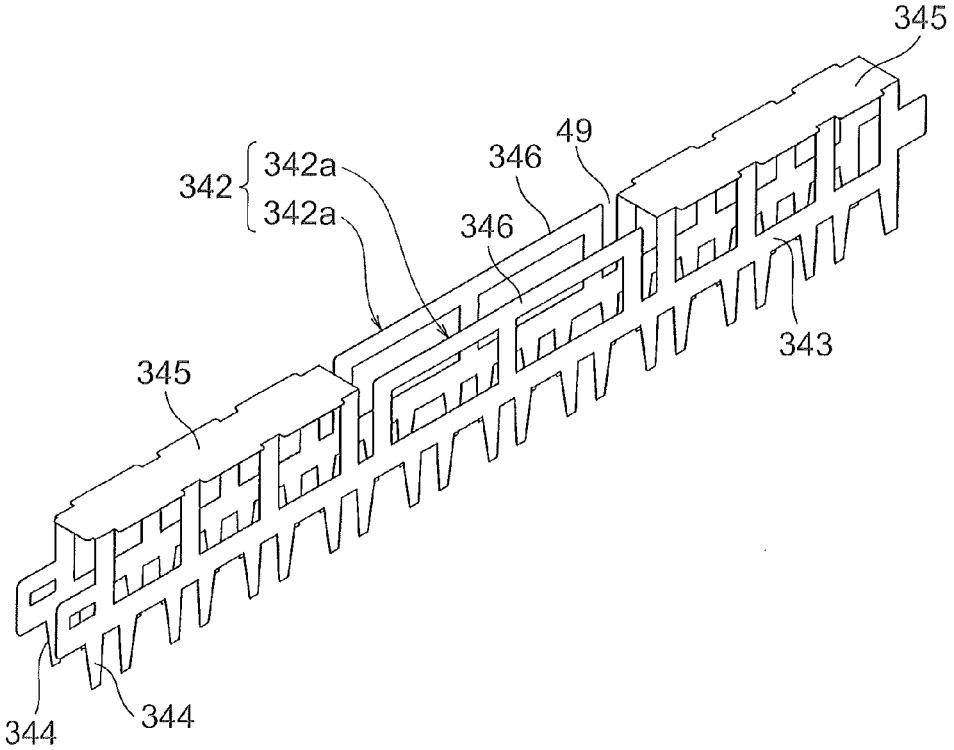
FIG. 21 is a perspective view showing a swing member of a second modification of the first embodiment.

FIG. 21 is a perspective view showing a swing member 342 of a second modification of the first embodiment. The swing member 342 of the second modification includes two swing member elements 342*a* provided in parallel with each other. Each swing member element 342*a* includes a deflection portion 344, a connecting portion 343 and a sliding portion 346 which are the same as the deflection portion 44, the connecting portion 43 and the sliding portion 46 shown in FIGS. 15 and 16. Further, these two swing member elements 342*a* have common fixed portions 345. The fixed portions 345 are formed so as to bridge the two swing member elements 342*a*.

Since the swing member 342 includes a plurality of swing member elements 342*a* and the common fixed portions 345 as shown in FIG. 21, it becomes possible to reduce the developer 4 adhering to the side surface of the developer storage body 31 opposing the first side surface 29.

Figure 22:
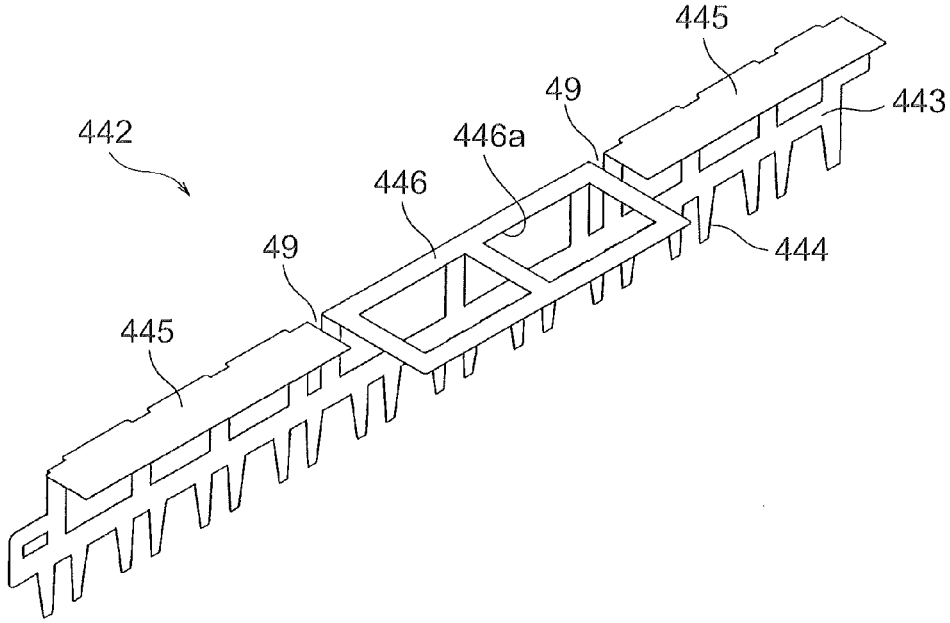
FIG. 22 is a perspective view showing a swing member of a third modification of the first embodiment.

FIG. 22 is a perspective view showing a swing member 442 of a third modification of the first embodiment. The swing member 442 of the third modification includes a sliding portion 446 having a bent shape. More specifically, the sliding portion 446 has a facing portion that faces the top surface 38 and extends along the top surface 38. Other portions (i.e., a deflection portion 444, a connecting portion 443 and fixed portions 445) of the swing member 442 are the same as those of the swing member 42 of FIGS. 15 and 16. In this regard, the sliding portion 446 has a plurality of openings 446*a* for enhancing efficiency in scraping the developer 4 by sliding.

Since the sliding portion 446 has the bent shape as shown in FIG. 22, a contact area where the sliding portion 446 contacts the top surface 38 becomes larger. Therefore, a larger amount of the develop 4 can be scraped from the top surface 38.

Figure 23:
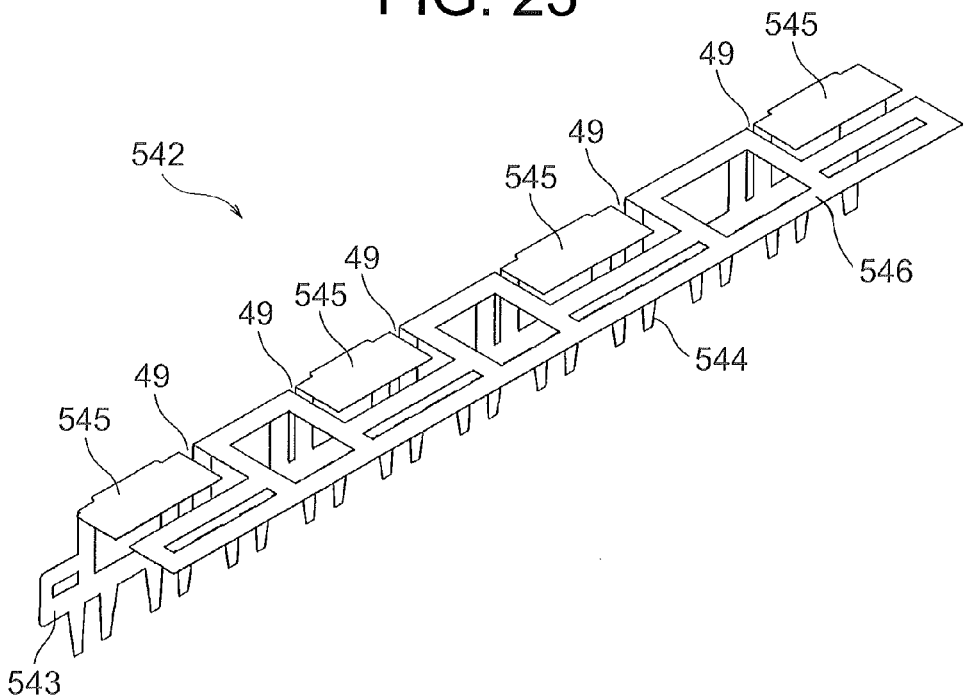
FIG. 23 is a perspective view showing a swing member of a fourth modification of the first embodiment.

FIG. 23 is a perspective view showing a swing member 542 of a fourth modification of the first embodiment. The swing member 542 of the fourth modification includes a plurality of (for example, four) fixed portions 545 having bent shapes. Each fixed portion 545 has a smaller area than the fixed portion 45 of the swing member 42 (FIG. 16). Further, the sliding portion 546 has a bent shape, and extends substantially throughout the length of the swing member 542. More specifically, the sliding portion 546 has a facing portion that faces the top surface 38 and extends throughout the length of the swing member 542. Other portions (i.e., a deflection portion 544 and a connecting portion 543) of the swing member 542 are the same as those of the swing member 42 of FIGS. 15 and 16.

With such a configuration, the swing member 542 can scrape the developer 4 adhering to a wider area of the top surface 38 in the longitudinal direction. Therefore, a larger amount of the developer 4 can be scraped from the top surface 38.

Figure 24:
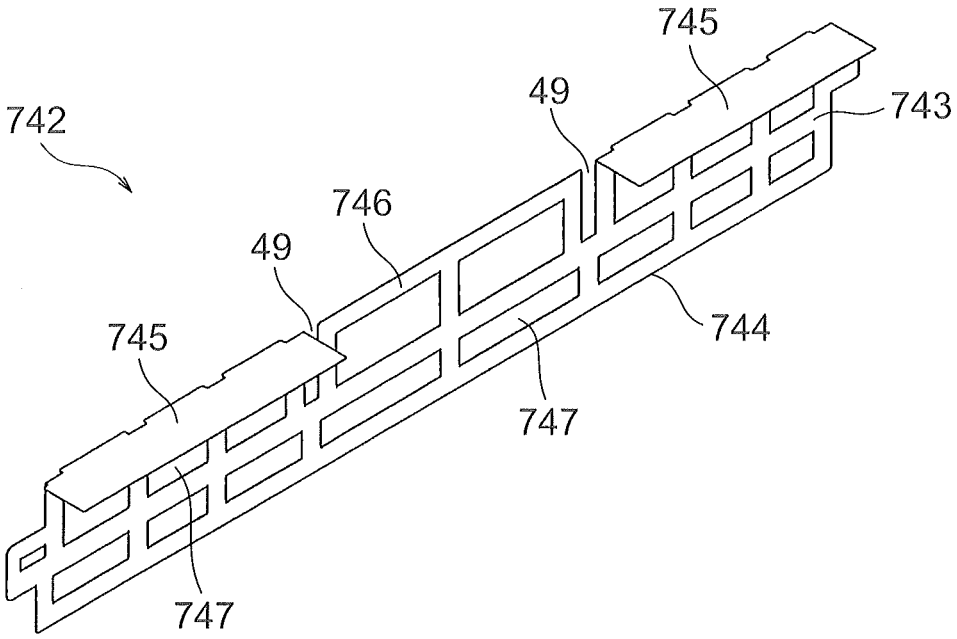
FIG. 24 is a perspective view showing a swing member of a fifth modification of the first embodiment.

FIG. 24 is a perspective view showing a swing member 742 of a fifth modification of the first embodiment. Although the above described deflection portion 44 of the swing member 42 (FIGS. 15 and 16) has a comb-like shape, a deflection portion 744 of the swing member 742 of the fourth modification includes has a plate shape. In this modification, the deflection portion 744 has a plurality of openings 747 for reducing a rotational load applied to the agitation member 35 when the swing member 742 contacts the agitation member 35. Other portions (i.e., a connecting portion 743, fixed portions 745 and a sliding portion 746) of the swing member 742 are the same as those of the swing member 42 of FIGS. 15 and 16.

Figure 25:
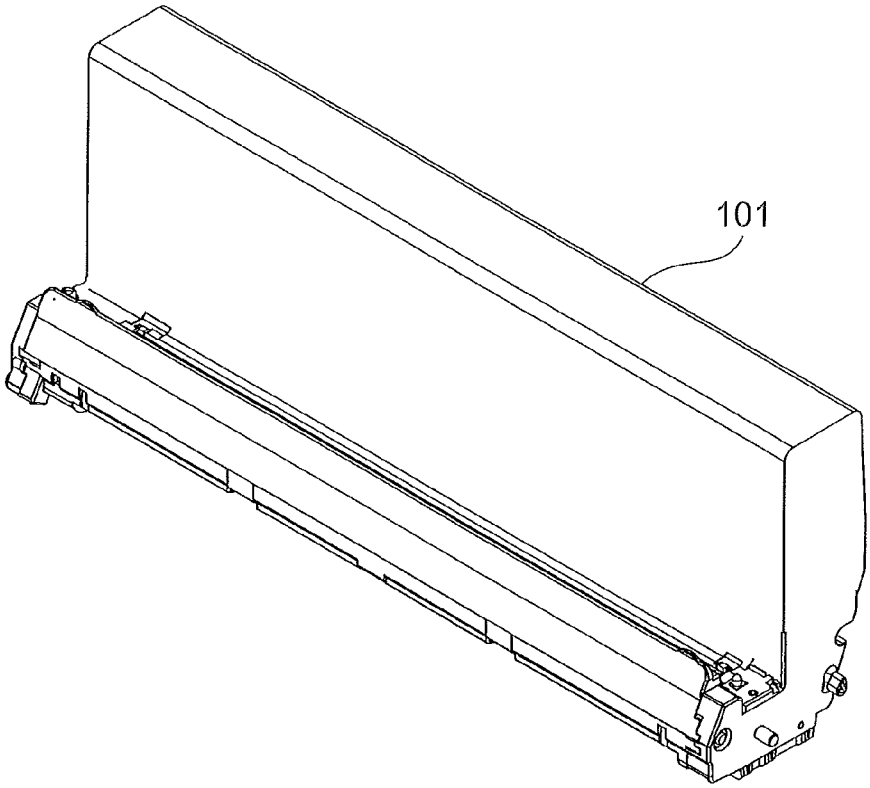
FIG. 25 is a perspective view showing a developer storage body-integrated developing unit of a sixth modification of the first embodiment.

FIG. 25 is a perspective view showing a developer storage body-integrated developing unit 101 of a sixth modification of the first embodiment. The above described developing unit 23 (FIG. 4) is configured so that the developer storage body 5 is detachably mounted to the developing unit 23. In contrast, the developer storage body-integrated developing unit 101 of the sixth modification is configured as an integral unit including the developing unit 23 and the developer storage body 5.

The swing member 42 and the agitation member 35 can be provided in the developer storage body-integrated developing unit 101 shown in FIG. 25. Therefore, the developer 4 adhering to the inner wall 36 can be scraped as described in the first embodiment.

Figure 26:
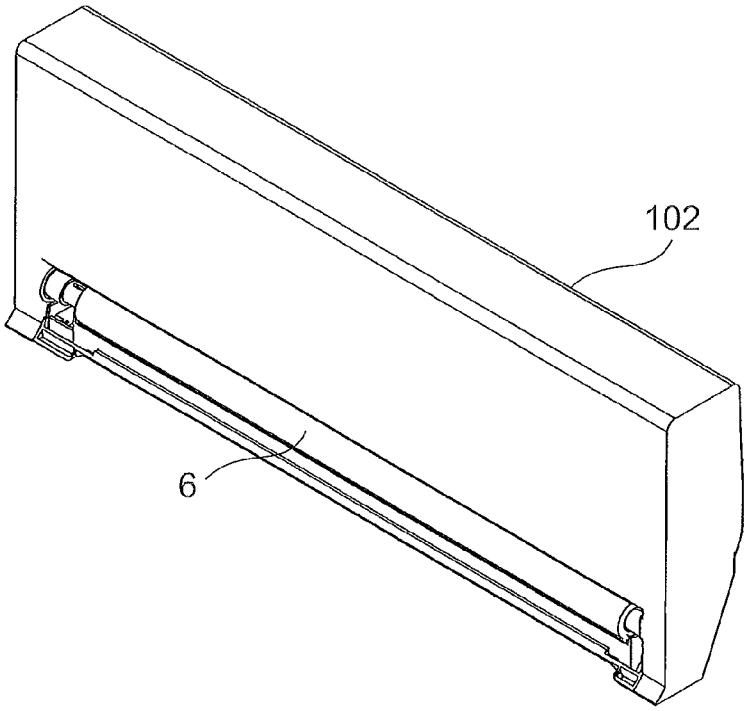
FIG. 26 is a perspective view showing a developing unit-type cartridge of a seventh modification of the first embodiment.

FIG. 26 is a perspective view showing a developing unit-type cartridge 102 of a seventh modification of the first embodiment. The developing unit-type cartridge 102 of the seventh modification is configured by mounting the developing roller 6, the developer supplying roller 8 and the like to the developer storage body 5.

The swing member 42 and the agitation member 35 can be provided in the developing unit-type cartridge 102 shown in FIG. 26. Therefore, the developer 4 adhering to the inner wall 36 can be scraped as described in the first embodiment.

Second Embodiment

<Configuration of Second Embodiment>

Next, a developer storage body, an image forming unit and an image forming apparatus of the second embodiment of the present invention will be described with reference to drawings. In the second embodiment, the present invention is applied to an electrophotographic color image forming apparatus.

Figure 27:
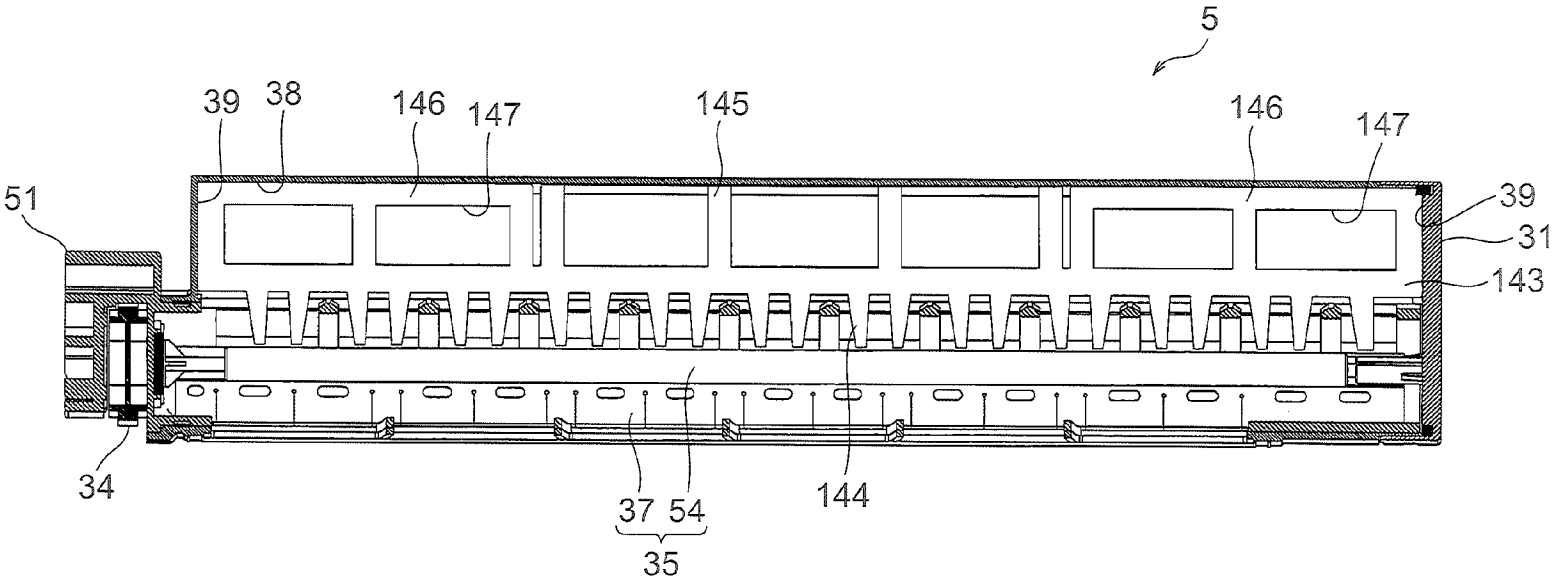
FIG. 27 is a longitudinal sectional view showing a developing unit according to the second embodiment.

FIG. 27 is a longitudinal sectional view showing a developer storage body 5 of the second embodiment. The second embodiment is different from the first embodiment in the structure of a swing member 142. The structure of the agitation member 35 of the second embodiment is the same as that of the first embodiment. Hereinafter, the structure of the swing member 142 of the second embodiment will be described.

Figure 28:
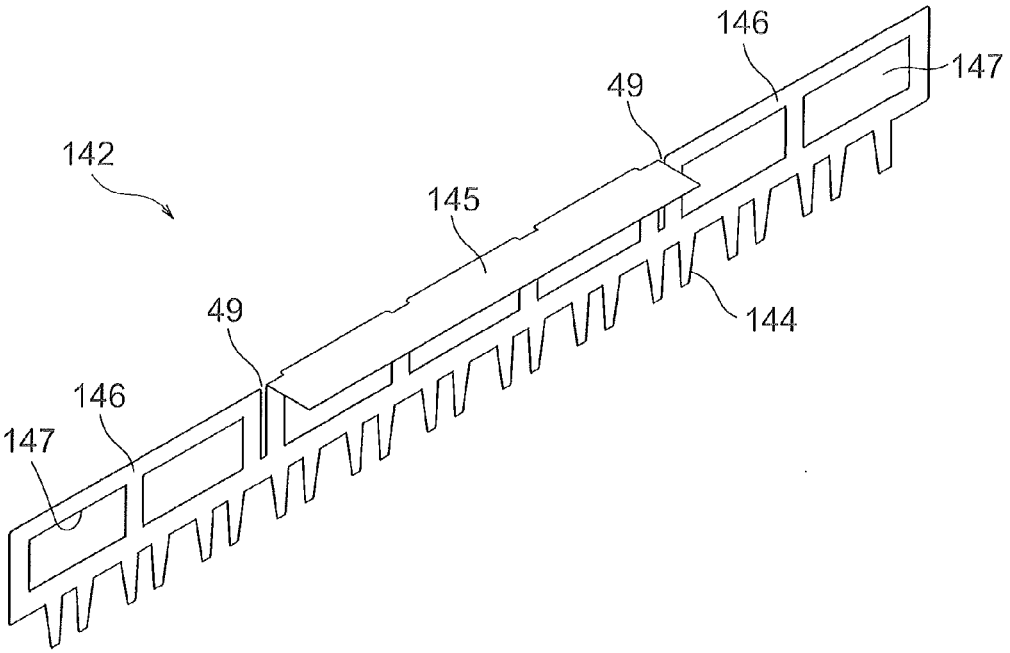
FIG. 28 is a perspective view showing a swing member according to the second embodiment.

FIG. 28 is a perspective view showing the swing member 142 of the second embodiment. The swing member 142 of the second embodiment has a deflection portion 144, a fixed portion 145 and two sliding portions 146. The deflection portion 144 is provided at an end portion (i.e., a first end portion) of the swing member 142 in a direction perpendicular to a longitudinal direction of the swing member 142. The fixed portion 145 and the sliding portions 146 are provided at the other end portion (i.e., a second end portion) of the swing member 142 in the direction perpendicular to the longitudinal direction of the swing member 142.

The two sliding portions 146 are provided on both end portions of the swing member 142 in the longitudinal direction of the swing member 142. The fixed portion 145 is provided at a center portion of the swing member 142 in the longitudinal direction of the swing member 142. That is, the fixed portion is provided between the two sliding portions 146. Slit portions 49 are formed between the fixed portion 145 and the two sliding portions 146. Further, the swing member 142 has a plurality of rectangular openings 147 for reducing a rotational load applied to the agitation member 35.

<Operation of Second Embodiment>

Figure 29A:
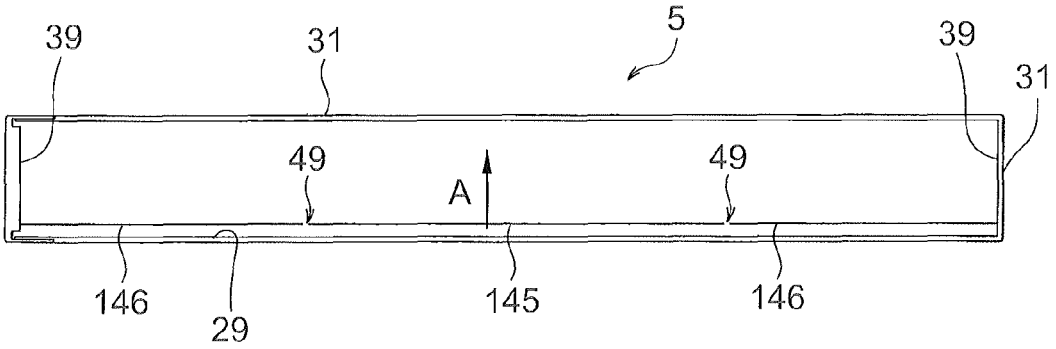
FIGS. 29A, 29B and 29C are views showing an operation of the swing member according to the second embodiment.
Figure 29B:
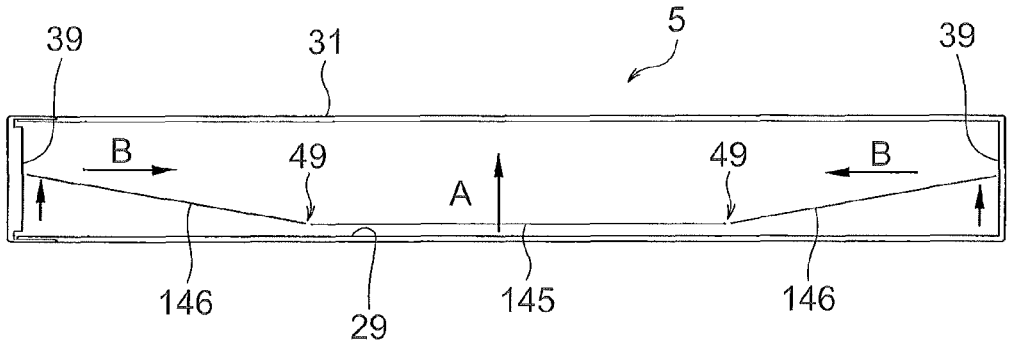
Figure 29C:
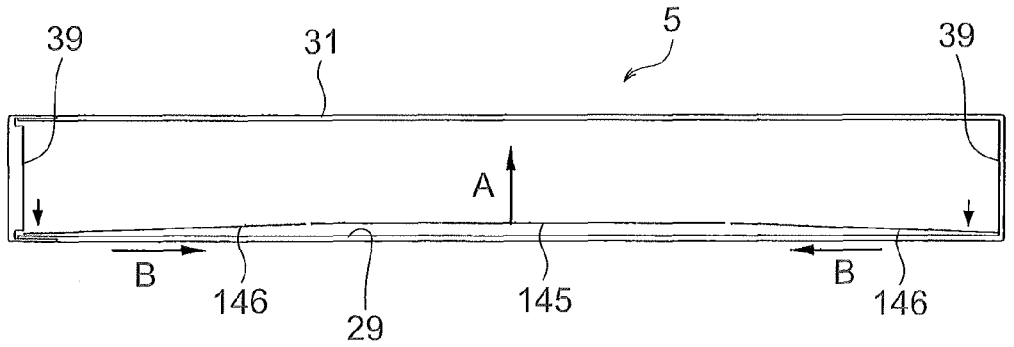

FIGS. 29A, 29B and 29C are explanatory views for illustrating an operation of the swing member 142 according to the second embodiment. In FIGS. 29A, 29B and 29C, the swing member 142 is illustrated as seen from above so that an entire deflection of the swing member 142 can be clearly seen. The agitation member 35 is omitted in FIGS. 29A, 29B and 29C.

FIG. 29A shows a state before the agitation member 35 and the swing member 142 contact each other. In FIG. 29A, the agitation member 35 rotates in the rotating direction A. However, the sheet 37 does not contact the deflection portion 144 of the swing member 142, and therefore the fixed portion 145 and the sliding portion 146 do not swing.

When the agitation member 35 rotates and contacts the swing member 142, the sliding portions 146 of the swing member 142 (which are not fixed to the inner wall 36 of the developer storage body 31) are bent at the slit portions 49 with respect to the fixed portion 145 as shown in FIG. 29B. The sliding portions 146 are deflected in the rotating direction A of the agitation member 35. Further, the sliding portions 146 are also deflected in directions B toward the center portion in the longitudinal direction of the swing member 142. The sliding potions 146 are deflected while sliding on the top surface 38 and second side surfaces 39 of the inner wall 36 of the developer storage portion 31, and scrape the developer 4 from the top surface 38 and second side surfaces 39. Further, the sliding portions 146 contact the first side surface 29, and scrape the developer 4 from the first side surface 29.

When the agitation member 35 further rotates and departs from the deflection portion 144 of the swing member 142, the sliding portions 146 of the swing member 142 are bent at the slit portions 49 and speedily move in a direction opposite to the rotating direction A as shown in FIG. 29C. Further, the sliding portions 146 also move in respective directions opposite to the directions B so that the swing member 142 returns to the original positions by its own resiliency. The swing member 142 moves beyond its original position by momentum, and therefore a vibration of the swing member 142 occurs. The vibration of the swing member 142 moves the surrounding developer 4, and disperses the agglomeration of the developer 4. Further, the swing member 42 contacts the first side surface 29, and scrapes the developer 4 adhering to the first side surface 29.

As the agitation member 35 continues to rotate, the sliding portion 146 scrapes the developer 4 from the inner wall 36 (particularly, the top surface 38, the first side surface 29 and the second side surfaces 39) of the developer storage portion 31 by moving and dispersing the developer 4.

<Effects of Second Embodiment>

According to the second embodiment of the present invention, the sliding portions 146 are provided on both ends of the swing member 142, and therefore the developer 4 can be scraped from the second side surfaces 139 (which are perpendicular to the longitudinal direction of the developer storage body 5) as well as the top surface 38 and the first side surface 29 (which is parallel to the longitudinal direction of the developer storage body 5). Therefore, the amount of the developer 4 remaining in the developer storage portion 31 can be reduced, and the developer 4 stored in the developer storage portion 31 can be efficiently and effectively used.

<Modifications>

Figure 30:
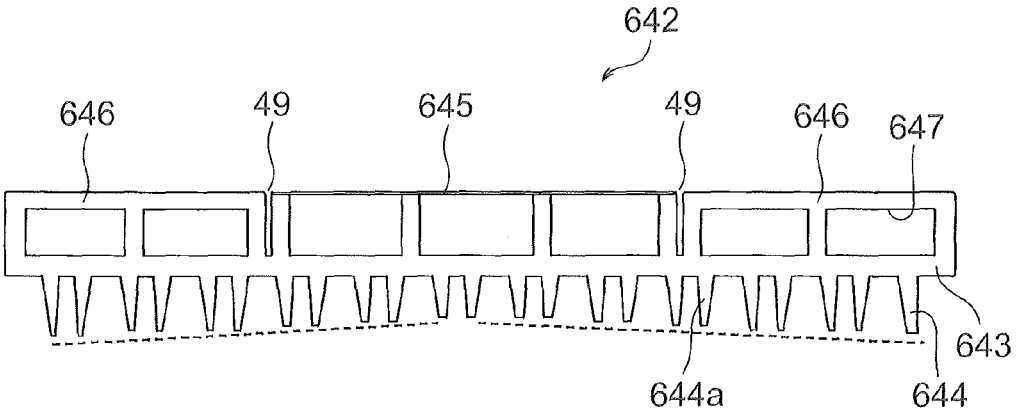
FIG. 30 is a front view showing a swing member of a modification of the second embodiment.
Figure 31:
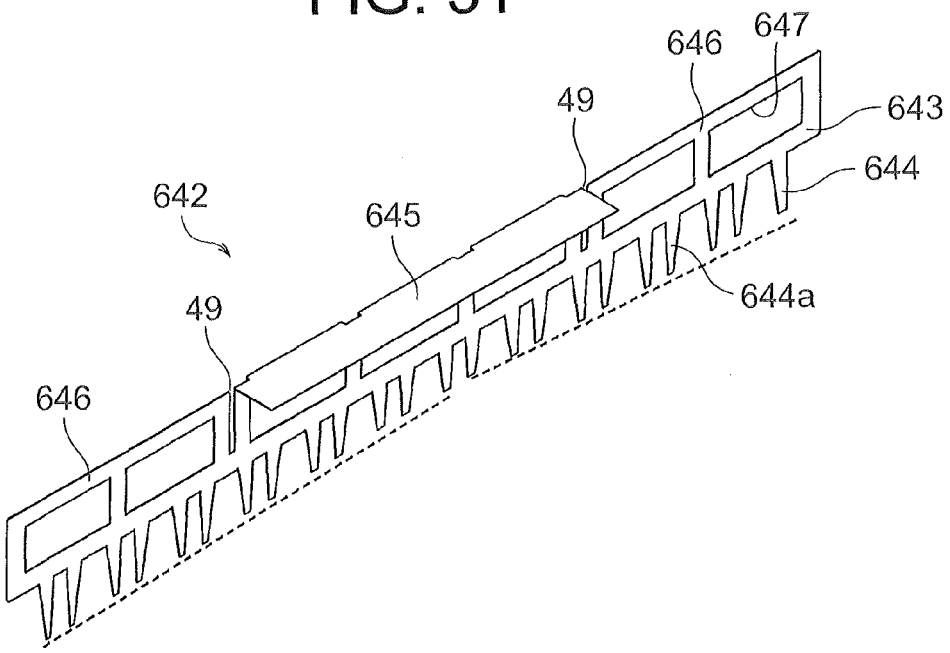
FIG. 31 is a perspective view showing the swing member of the modification of the second embodiment.

FIGS. 30 and 31 are a front view and a perspective view of a swing member 642 of a first modification of the second embodiment.

The swing member 642 of the modification has a plurality of comb-teeth 644*a* arranged along a longitudinal direction of the swing member 642. Lengths of the comb-teeth 644*a* of a center portion of the swing member 642 in the longitudinal direction are shorter than lengths of the comb-teeth 644*a* of both end portions of the swing member 642. That is, the deflection portion 644 of the swing member 642 has the comb-teeth 644*a* whose lengths are different depending on a position in the longitudinal direction of the swing member 642. For example, the length of the comb-tooth 644*a* increases from the center portion of the swing member 642 toward either end portion of the swing member 642. Other portions (i.e., a connecting portion 643, fixed portions 645 and a sliding portion 646) of the swing member 642 are the same as those of the swing member 42 of FIG. 28.

At a portion where the comb-teeth 644*a* have longer lengths, the swing member 642 (particularly, the sliding portion 646) can swing over a larger range. Therefore, by making the comb-teeth 644*a* longer at a portion corresponding to an area where the developer 4 tends to adhere to the inner wall 36 of the developer storing portion 31, the sliding portion 646 can effectively scrape the developer 4 from the inner wall 36 (by moving and dispersing the developer 4).

Further, the first modification of the first embodiment (FIG. 20) can be applied to the second embodiment. That is, the swing member 142 of the second embodiment can be made of a plurality of swing member elements.

The second modification of the first embodiment (FIG. 21) can be applied to the second embodiment. That is, the swing member 142 of the second embodiment can be made of a plurality of swing member elements (each including the deflection portion and the sliding portion) and the common fixed portions.

The third modification of the first embodiment (FIG. 22) can be applied to the second embodiment. That is, the sliding portion 146 of the swing member 142 can have a bent shape and have openings.

The fourth modification of the first embodiment (FIG. 23) can be applied to the second embodiment. That is, the swing member 142 can have a larger number of fixed portions 145, and the sliding portion 146 can be formed to extend throughout the length of the swing member 142.

The fifth modification of the first embodiment (FIG. 24) can be applied to the second embodiment. That is, the deflection portion 144 of the swing member 142 can have a plate shape with a plurality of openings.

Additionally, the sixth and seventh modifications of the first embodiment (FIGS. 25 and 26) can be applied to the second embodiment.

Other Examples

The first and second embodiments (and their modifications) have been described. However, the present invention is also applicable to the following examples.

The first and second embodiments can be applied to a printer, a facsimile machine, a copier, or a multifunction peripheral having a plurality of these functions.

In the first and second embodiments, the deflection portion of the swing member has the comb-like shape. However, the shape of the deflection portion is not limited to the comb-like shape. The deflection portion can have various shapes as long as the deflection portion can be deflected by contact with the rotating agitating portion.

In the first and second embodiments, the fixed portion of the swing member is fixed so as to allow the deflection portion to be deflected when the deflection portion contacts the rotating agitation member. In this regard, it is only necessary that the fixed portion is fixed to the inner wall (for example, the top surface) or other part of the developer storage body.

In the first and second embodiments, the sliding portion of the swing member has openings. The openings can have various shapes such as rectangle, circle, triangle, polygon, ellipse or the like. It is only necessary that the sliding portion slides on the inner wall (i.e., the top surface or the side surface) of the developer storage body.

In the modification shown in FIG. 20, a plurality of the swing member elements are arranged in the rotating direction of the agitation member. However, it is also possible to arrange the swing member elements in the longitudinal direction of the agitation member.

While the preferred embodiments of the present invention have been illustrated in detail, it should be apparent that modifications and improvements may be made to the invention without departing from the spirit and scope of the invention as described in the following claims.

What is claimed is:

1. A developer storage body comprising:
a storage portion for storing a developer;
an agitation member for agitating the developer stored in the storage portion;
a swing member that swings in the storage portion by contact with the agitation member, the swing member including:
a contact portion provided at a first end portion of the swing member, the contact portion contacting the agitation member;
a fixed portion provided at a second end portion of the swing member, the fixed portion being fixed to the storage portion; and
a swing portion provided at the second end portion of the swing member, the swing portion swinging in the storage portion; and
a fixing surface to which the fixed portion is fixed;
wherein the swing portion swings so as to contact the fixing surface.

2. The developer storage body according to claim 1, wherein a length of the contact portion is shorter than a length of the swing portion.

3. The developer storage body according to claim 1, wherein the swing member includes a connecting portion that connects the contact portion and the swing portion.

4. The developer storage body according to claim 1, wherein the swing portion has an opening.

5. The developer storage body according to claim 1, wherein the swing member is made of a sheet.

6. The developer storage body according to claim 1, wherein the contact portion has a comb-like shape.

7. The developer storage body according to claim 1, wherein the swing member includes at least two fixed portions, and
wherein the swing portion is provided between the fixed portions.

8. The developer storage body according to claim 1, wherein when the contact portion contacts the agitation member, the contact portion is deflected about the fixed portion, and
wherein when the contact portion is released from contact with the agitation member, the contact portion moves to recover a shape of the contact portion before being deflected, which causes the swing portion to swing.

9. The developer storage body according to claim 1, further comprising:
an ejection portion for ejecting the developer stored in the storage portion; and
an opposing surface that opposes the ejection portion,
wherein the fixed portion is fixed to the opposing surface.

10. The developer storage body according to claim 1, further comprising an adjacent surface provided adjacent to the fixing surface, and
wherein the swing portion swings so as to contact the adjacent surface.

11. The developer storage body according to claim 1, wherein the swing member has an elongated shape;
wherein the first end portion of the swing member is an end of the swing member in a direction perpendicular to a longitudinal direction of the swing member; and
wherein the second end portion of the swing member is the other end of the swing member in the direction perpendicular to the longitudinal direction of the swing member.

12. The developer storage body according to claim 1, wherein the agitation member includes a rotation member and a sheet member provided on the rotation member, and
wherein when the agitation member rotates, the sheet member pushes the swing member to cause the swing member to swing.

13. An image forming unit comprising:
the developer storage body according to claim 1, and
a developing unit that develops a latent image on a surface of an image bearing body using the developer supplied from the developer storage body.

14. An image forming apparatus comprising:
the image forming unit according to claim 13, and
a transfer unit that transfers an image of the developer from the surface of the image bearing body of the image forming unit to a medium.

15. A developer storage body, comprising:
a storage portion for storing a developer;
an agitation member for agitating the developer stored in the storage portion; and
a swing member that swings in the storage portion by contact with the agitation member;
wherein the swing member includes:
a contact portion provided at a first end portion of the swing member, the contact portion contacting the agitation member;
a fixed portion provided at a second end portion of the swing member, the fixed portion being fixed to the storage portion; and
a swing portion provided at the second end portion of the swing member, the swing portion swinging in the storage portion;
wherein the swing member includes at least two swing portions, and
wherein the fixed portion is provided between the swing portions.

16. A developer storage body comprising:
a storage portion for storing a developer;
an agitation member for agitating the developer stored in the storage portion; and a swing member that swings in the storage portion by contact with the agitation member;

wherein the swing member includes:

a contact portion provided at a first end portion of the swing member, the contact portion contacting the agitation member;

an engaging portion provided at a second end portion of the swing member, the engaging portion engaging with the storage portion; and a swing portion provided between the contact portion and the engaging portion, the swing portion swinging in the storage portion;

wherein the contact portion has a comb-like shape;

wherein the swing portion includes an extending portion disposed on a contact portion side, and a connecting portion disposed on an engaging portion side, the extending portion continuously extending in a longitudinal direction of the swing member, the connecting portion including a plurality of rectangular openings; and wherein the swing member includes a top portion corresponding to a top surface of the developer storage portion, and a portion extending from the top portion in a substantially vertical direction.

17. The developer storage body according to claim 16, wherein the swing member includes a protrusion that protrudes from a side end of the swing member.

* * * * *